US012722929B1

(12) United States Patent
Morgan

(10) Patent No.: US 12,722,929 B1
(45) Date of Patent: Sep. 1, 2026

(54) SYSTEM AND METHODS FOR AUTOMATED TAPE DISPENSING

(71) Applicant: Ascension Automation Solutions Ltd, Cambridge (CA)

(72) Inventor: Andrew Morgan, Guelph (CA)

(73) Assignee: Ascension Automation Solutions Ltd., Cambridge (CA)

( * ) Notice: Subject to any disclaimer, the term of this patent is extended or adjusted under 35 U.S.C. 154(b) by 0 days.

(21) Appl. No.: 19/267,293

(22) Filed: Jul. 11, 2025

(51) Int. Cl.
*B65H 35/00* (2006.01)

(52) U.S. Cl.
CPC ..... *B65H 35/0086* (2013.01); *B65H 35/006* (2013.01); *B65H 2551/20* (2013.01); *B65H 2555/30* (2013.01); *B65H 2557/63* (2013.01); *B65H 2701/377* (2013.01)

(58) Field of Classification Search
USPC ..... 156/574, 577, 486
See application file for complete search history.

(56) References Cited

U.S. PATENT DOCUMENTS 4,461,669 A * 7/1984 Dontscheff ..... B29C 70/388 156/577
4,750,960 A * 6/1988 Bubeck ..... B65H 71/007 156/169

FOREIGN PATENT DOCUMENTS

CN 118083214 A 5/2024
IN 202211017328 A 10/2022
IN 202341023668 A 10/2024
WO WO-9529116 A1 * 11/1995 ..... B65H 35/0013
WO WO-2005105441 A1 * 11/2005 ..... B65H 35/0013

OTHER PUBLICATIONS

English machine translation of KR 20200163804 to Kang published Nov. 19, 2024; 24 pages. (Year: 2024).*
David Gersovitz Robotic Dispenser Helps Expand Use of Pressure-Sensitive Adhesives Apr. 15, 2024.

* cited by examiner

*Primary Examiner* — Linda L Gray
(74) *Attorney, Agent, or Firm* — CALDWELL LLC

(57) ABSTRACT

A system and method for automated tape dispensing. The system includes a multi-axis robotic arm affixed to a first surface at a proximal end, at least a mounting axle plate coupled to a distal end of the multi-axis robotic arm, the at least a mounting axle plate comprises a mounting axle, at least a mounting axle motor, at least an adhesive roll, plate coupled to a distal area of the second surface of the at least a mounting axle plate, the plate comprises linear guide rails, at least a piston, at least a cutting system coupled to the third surface of the plate, the at least a cutting system comprising at least a blade, at least a tensioning system coupled to the third surface of the plate, and at least a powered roller motor.

16 Claims, 11 Drawing Sheets

300

SYSTEM AND METHODS FOR AUTOMATED TAPE DISPENSING

FIELD OF THE INVENTION

The present invention generally relates to the field of robotics. In particular, the present invention is directed to a system and a method for automated tape dispensing.

BACKGROUND

In industrial taping processes, particularly in high-throughput environments, manual or semi-automated tape dispensing often leads to inconsistent application, imprecise cuts, and misalignment over time. Traditional systems typically operate at fixed speeds without responsive adjustments, which can result in tension fluctuations, material jams, or inefficient tape usage. Moreover, the lack of intelligent feedback and system-level visibility limits operational control, increases downtime, and complicates predictive maintenance efforts across production cycles.

SUMMARY OF THE DISCLOSURE

In an aspect, a system for automated tape dispensing includes a multi-axis robotic arm affixed to a first surface at a proximal end, at least a mounting axle plate coupled to a distal end of the multi-axis robotic arm, wherein the at least a mounting axle plate includes a mounting axle protruding from a second surface of the at least a mounting axle plate, at least a mounting axle motor coupled to the mounting axle of the at least a mounting axle plate, wherein the at least a mounting axle motor is configured to conditionally rotate the mounting axle upon receipt of a system command, at least an adhesive roll attached to the mounting axle of the at least a mounting axle plate, wherein the at least an adhesive roll includes a strip of adhesive, plate coupled to a distal area of the second surface of the at least a mounting axle plate, wherein the plate includes linear guide rails coupled to the third surface of the plate, wherein the linear guide rails are configured to guide a translation of the plate, at least a piston coupled to the surface of the at least a mounting axle plate, wherein the at least a piston is configured to power the translation of the plate on the linear guide rails, at least a cutting system coupled to the third surface of the plate, the at least a cutting system comprising at least a blade, wherein the at least a cutting system is configured to cut, using the at least a blade, a segment of the strip of adhesive, at least a tensioning system coupled to the third surface of the plate, the at least a tensioning system comprising a guide roller, wherein the at least a tensioning system is configured to apply a force to the guide roller and against the strip of adhesive, and at least a powered roller motor coupled to the third surface of the plate, the at least a powered roller motor configured to drive the strip of adhesive in a forward direction.

In another aspect, a method for automated tape dispensing, the method includes receiving, using at least a processor, an input and generating, using the at least a processor, an output, wherein the output is executed at the at least a mounting axle motor and the at least a powered roller motor, wherein the output comprises one or more control signals configured to adjust a rotational speed of the mounting axle motor and the powered roller motor as a function of the input.

In another aspect, a method for monitoring adhesive usage in an automated tape dispensing system, the method includes receiving, using at least a processor, sensor data comprising a length of a strip of adhesive, comparing, using the at least a processor, the length of the strip of adhesive to one or more predetermined thresholds, generating, using the at least a processor, an alert when the length of the strip of adhesive falls below a threshold of the one or more predetermined thresholds, and transmitting, using the at least a processor, the alert to a graphical user interface of a downstream device.

In another aspect, a method for dynamically adjusting motor speeds in an automated tape dispensing system, the method includes receiving, using at least a sensor communicatively connected to at least a mounting axle motor and at least a powered roller motor, feedback data associated with at least a dispensing rate, analyzing, using at least a processor communicatively connected to the at least a sensor, the feedback data to determine a deviation from one or more target operational parameters, and transmitting, using the at least a processor, control signals to at least a mounting axle motor and at least a powered roller motor to adjust an axle motor speed and a power roller motor speed as a function of the deviation.

In another aspect, a method for controlling output signals in an automated tape dispensing system, the method includes receiving, using at least a processor communicatively connected to a pneumatic system of a cutting system, an input comprising one or more of a speed command and a blade activation signal, executing the speed command to regulate a rotational speed of at least a mounting axle motor and at least a powered roller motor, and executing the blade activation signal to trigger the cutting system to sever a strip of adhesive at a length or time based on one or more operational criteria.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

Figure 1A:
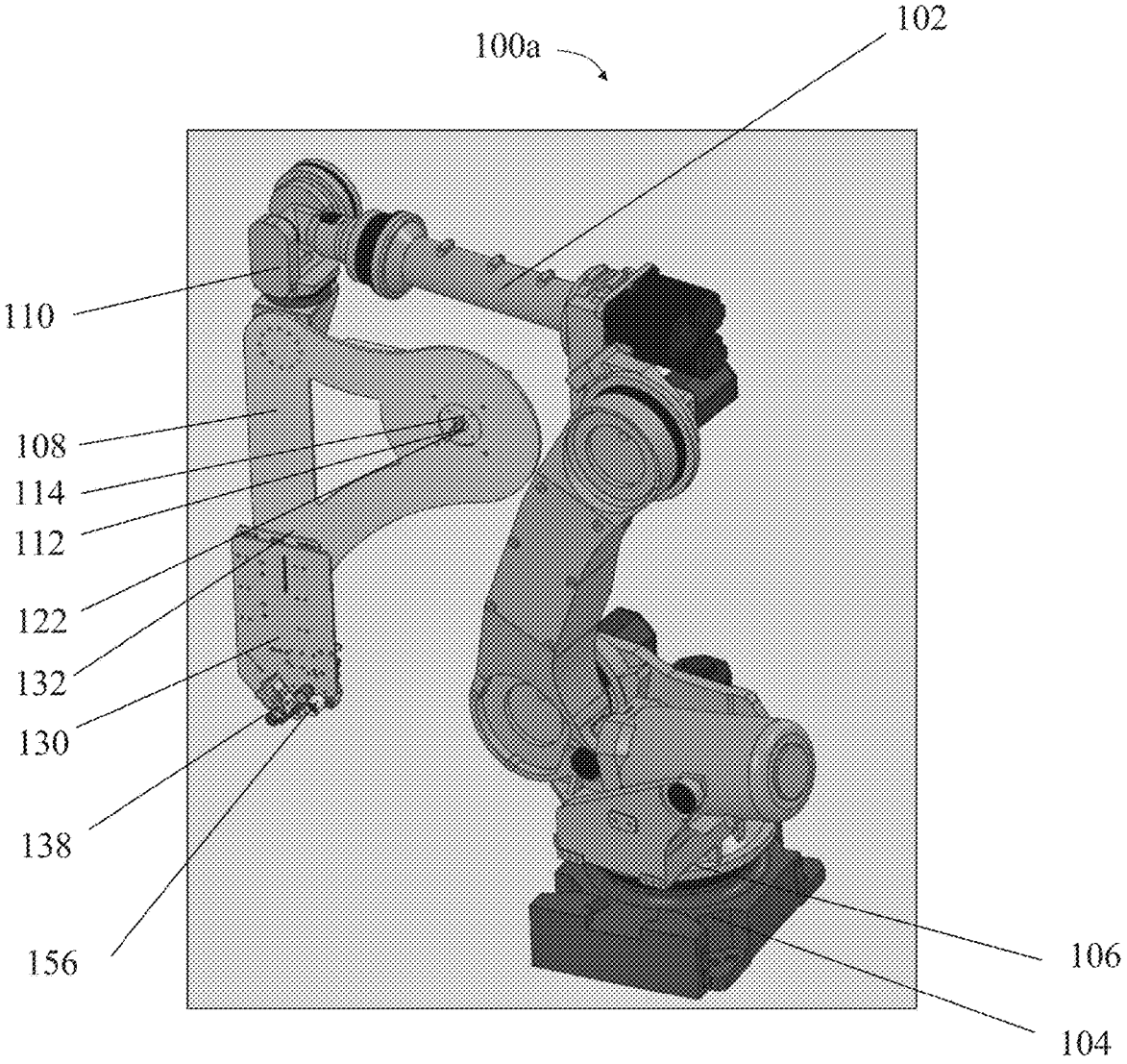
FIG. 1A is an exemplary illustration of an isometric front view of a system for automated tape dispensing.
Figure 1C:
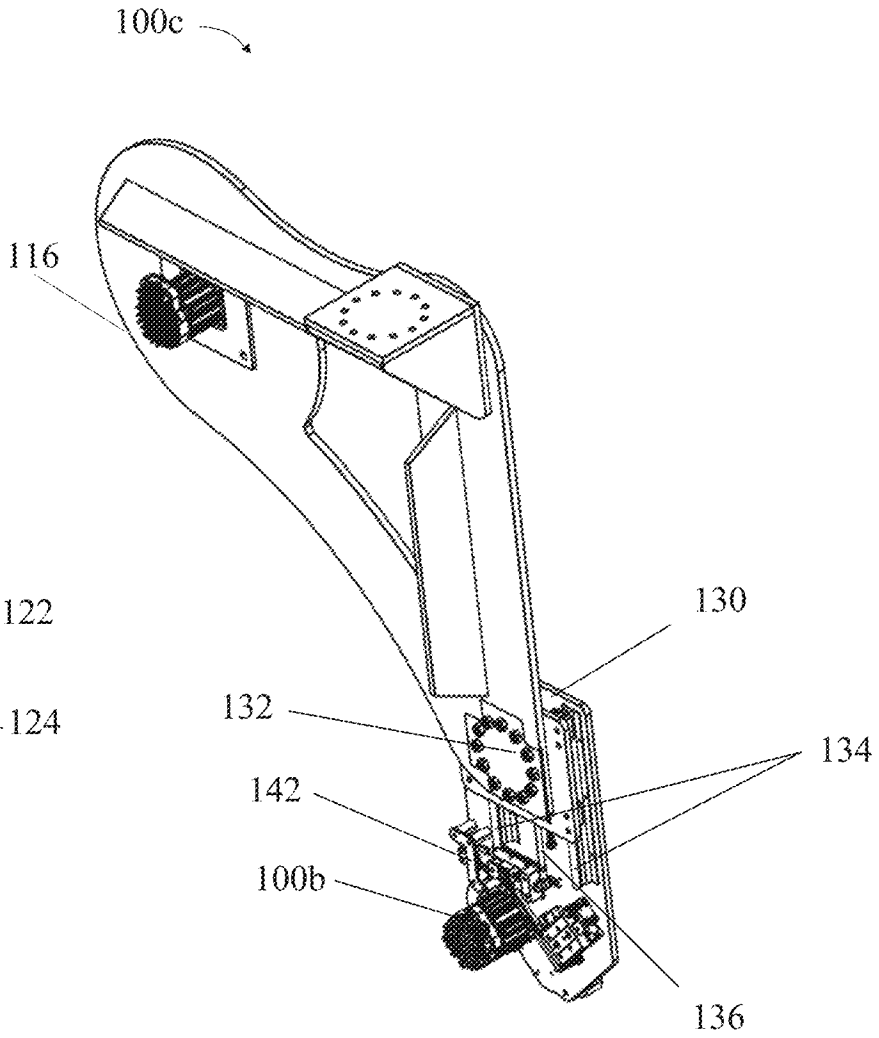
FIG. 1C is an exemplary illustration of an isometric back view of at least a mounting axle plate.
Figure 1B:
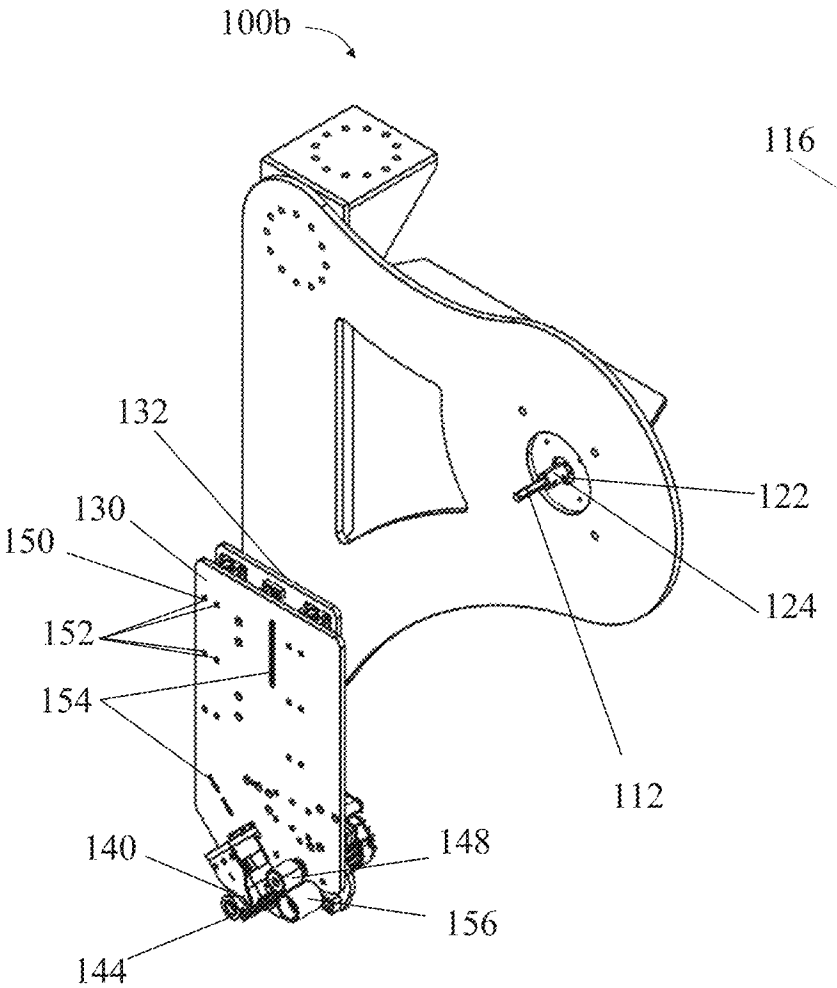
FIG. 1B is an exemplary illustration of an isometric front view of at least a mounting axle plate.
Figure 1D:
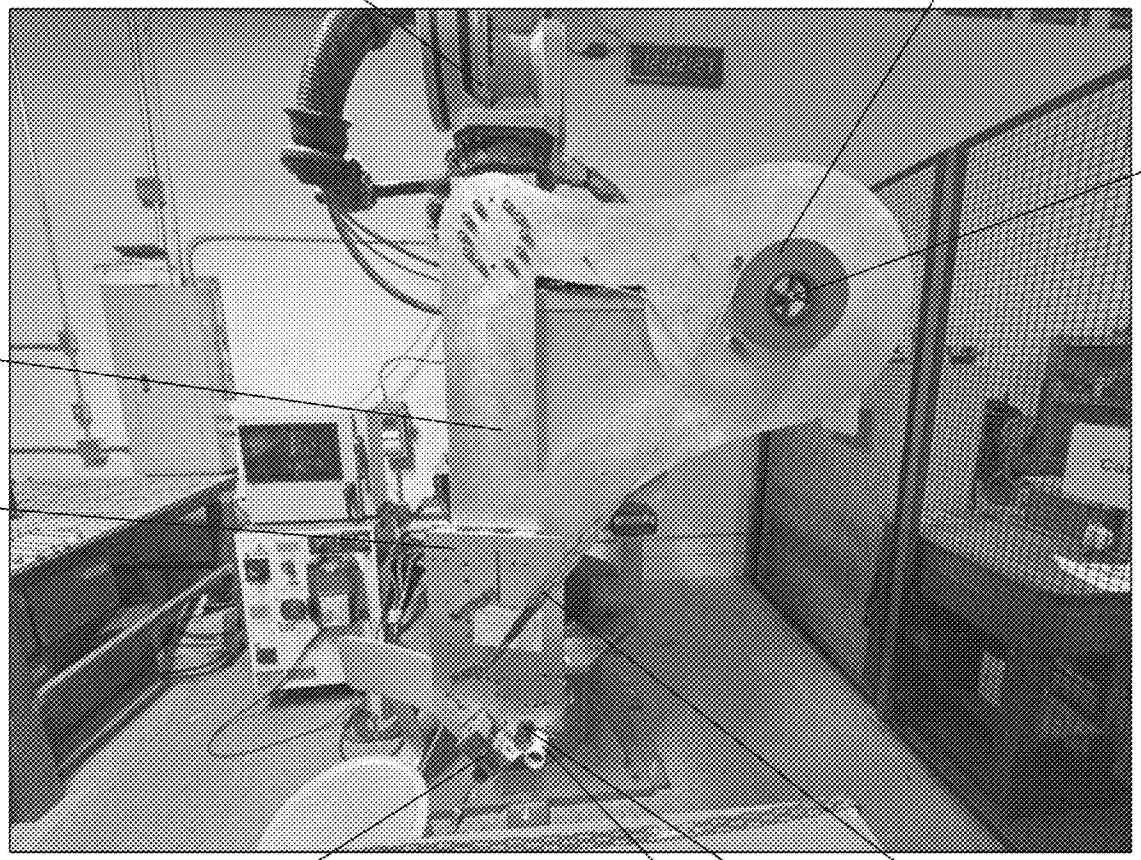
FIG. 1D is an image of a system for automated tape dispensing comprising at least an adhesive roll attached to a mounting axle of at least a mounting axle plate.
Figure 1E:
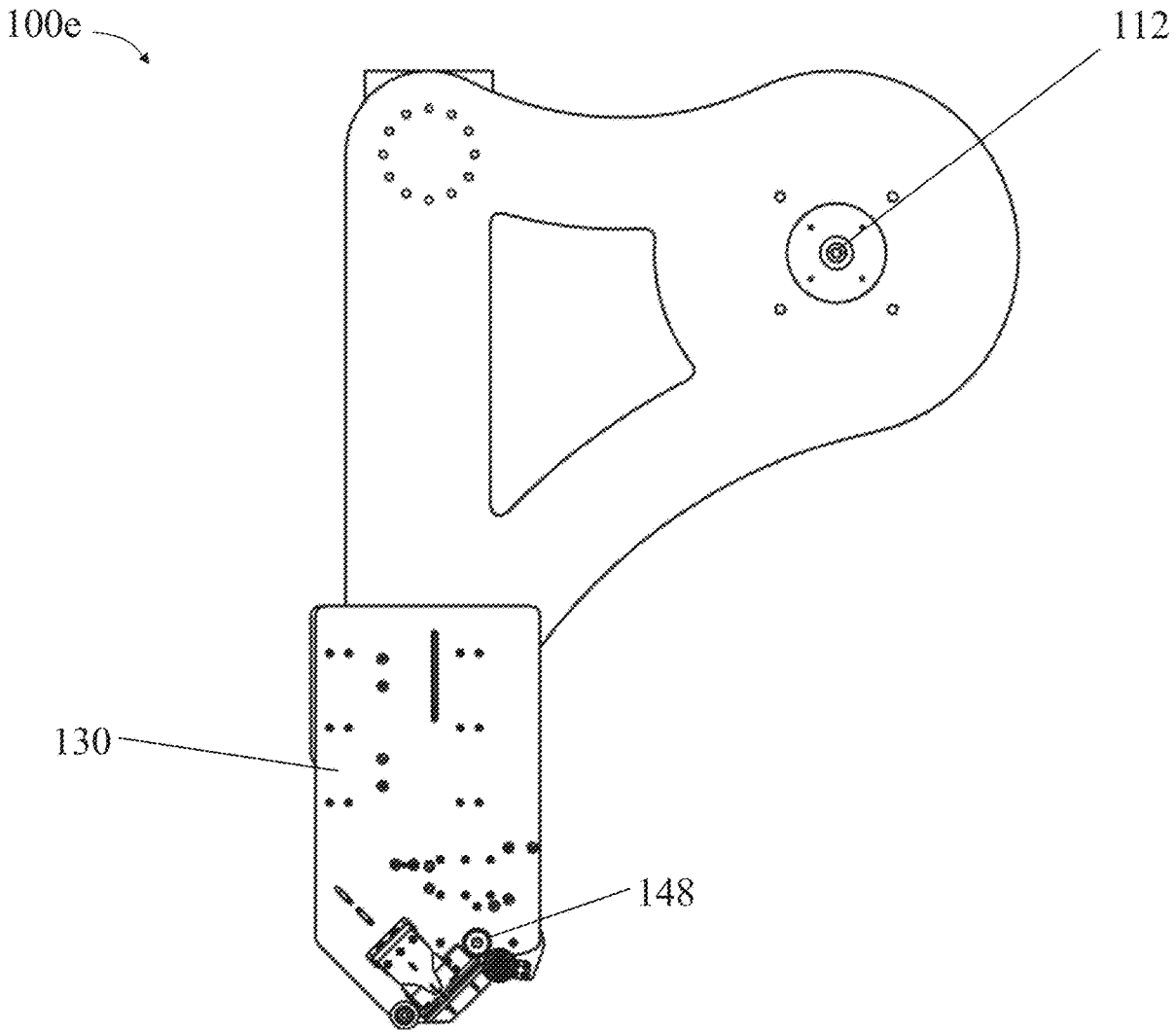
FIG. 1E is an exemplary illustration of a front view of a system for automated tape dispensing.
Figure 1G:
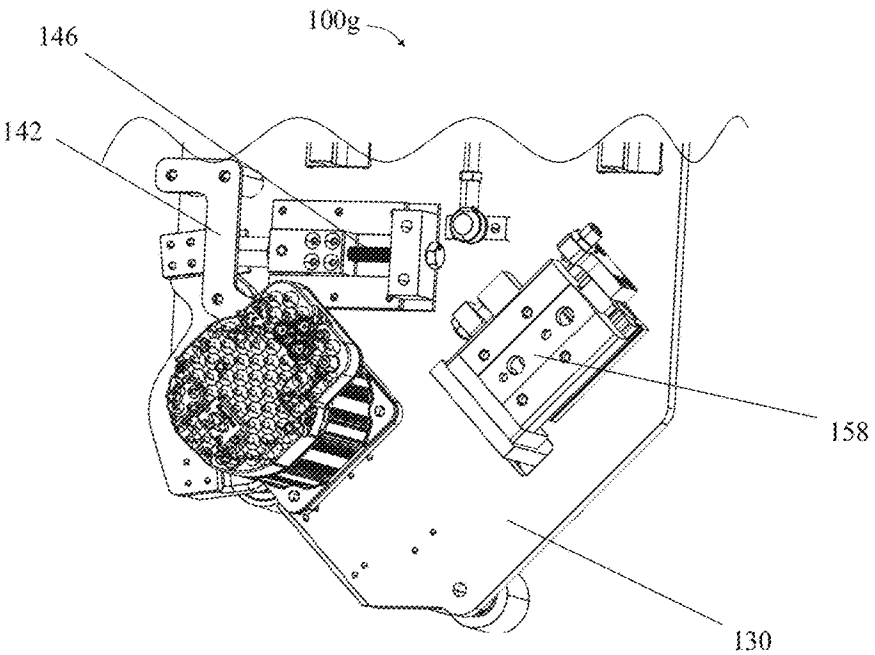
FIG. 1G is a block diagram of a system for automated tape dispensing includes at least a tensioning system.
Figure 1F:
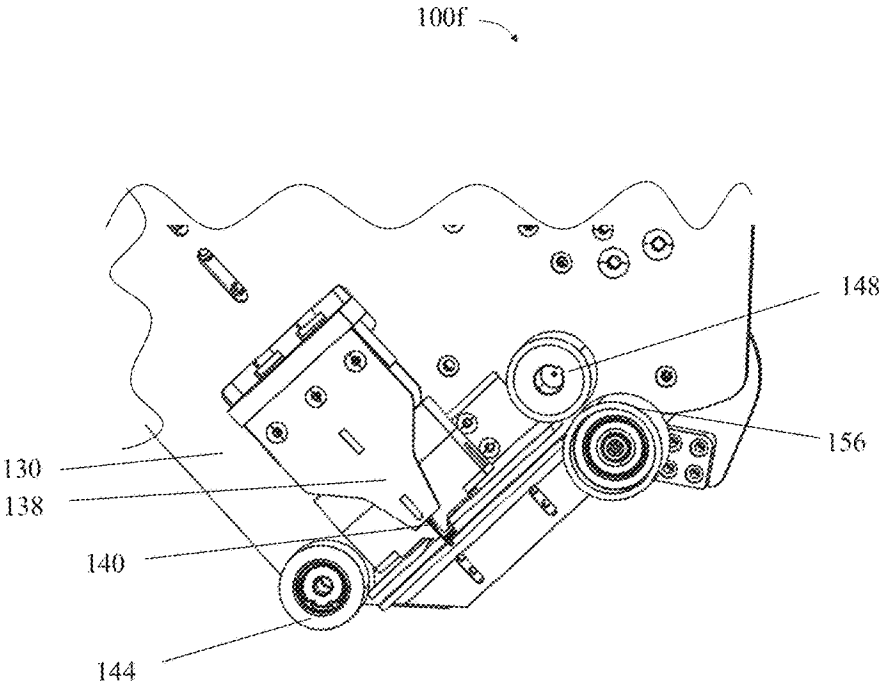
FIG. 1F is an exemplary illustration of a front partial view of a system for automated tape dispensing includes at least a cutting system, at least a powered roller motor, and at least a blade.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

At a high level, aspects of the present disclosure are directed to a system and methods for automated tape dispensing. The system includes a multi-axis robotic arm affixed to a first surface at a proximal end, at least a mounting axle plate coupled to a distal end of the multi-axis robotic arm, wherein the at least a mounting axle plate comprises a mounting axle protruding from a second surface of the at least a mounting axle plate, at least a mounting axle motor coupled to the mounting axle of the at least a mounting axle plate, wherein the at least a mounting axle motor is configured to conditionally rotate the mounting axle upon receipt of a system command, at least an adhesive roll attached to the mounting axle of the at least a mounting axle plate, wherein the at least an adhesive roll comprises a strip of adhesive, plate coupled to a distal area of the second surface of the at least a mounting axle plate, wherein the plate comprises linear guide rails coupled to the third surface of the plate, wherein the linear guide rails are configured to guide a translation of the plate, at least a piston coupled to the surface of the at least a mounting axle plate, wherein the at least a piston is configured to power the translation of the plate on the linear guide rails, at least a cutting system coupled to the third surface of the plate, the at least a cutting system comprising at least a blade, wherein the at least a cutting system is configured to cut, using the at least a blade, a segment of the strip of adhesive, at least a tensioning system coupled to the third surface of the plate, the at least a tensioning system comprising a guide roller, wherein the at least a tensioning system is configured to apply a force to the guide roller and against the strip of adhesive, and at least a powered roller motor coupled to the third surface of the plate, the at least a powered roller motor configured to drive the strip of adhesive in a forward direction.

Referring now to FIGS. 1A-G, an exemplary embodiment of system 100*a-g* for automated tape dispensing is illustrated. System 100*a-g* may include a processor communicatively connected to a memory. As used in this disclosure, "communicatively connected" means connected by way of a connection, attachment, or linkage between two or more relata which allows for reception and/or transmittance of information therebetween. For example, and without limitation, this connection may be wired or wireless, direct or indirect, and between two or more components, circuits, devices, systems, and the like, which allows for reception and/or transmittance of data and/or signal(s) therebetween. Data and/or signals there between may include, without limitation, electrical, electromagnetic, magnetic, video, audio, radio and microwave data and/or signals, combinations thereof, and the like, among others. A communicative connection may be achieved, for example and without limitation, through wired or wireless electronic, digital or analog, communication, either directly or by way of one or more intervening devices or components. Further, communicative connection may include electrically coupling or connecting at least an output of one device, component, or circuit to at least an input of another device, component, or circuit. For example, and without limitation, via a bus or other facility for intercommunication between elements of a computing device. Communicative connecting may also include indirect connections via, for example and without limitation, wireless connection, radio communication, low power wide area network, optical communication, magnetic, capacitive, or optical coupling, and the like. In some instances, the terminology "communicatively coupled" may be used in place of communicatively connected in this disclosure.

With continued reference to FIGS. 1A-G, memory may include a primary memory and a secondary memory. "Primary memory" also known as "random access memory" (RAM) for the purposes of this disclosure is a short-term storage device in which information is processed. In one or more embodiments, during use of the computing device, instructions and/or information may be transmitted to primary memory wherein information may be processed. In one or more embodiments, information may only be populated within primary memory while a particular software is running. In one or more embodiments, information within primary memory is wiped and/or removed after the computing device has been turned off and/or use of a software has been terminated. In one or more embodiments, primary memory may be referred to as "Volatile memory" wherein the volatile memory only holds information while data is being used and/or processed. In one or more embodiments, volatile memory may lose information after a loss of power. "Secondary memory" also known as "storage," "hard disk drive" and the like for the purposes of this disclosure is a long-term storage device in which an operating system and other information is stored. In one or more embodiments, information may be retrieved from secondary memory and transmitted to primary memory during use. In one or more embodiments, secondary memory may be referred to as non-volatile memory wherein information is preserved even during a loss of power. In one or more embodiments, data within secondary memory cannot be accessed by processor. In one or more embodiments, data is transferred from secondary to primary memory wherein processor may access the information from primary memory.

Still referring to FIGS. 1A-G, system 100*a-g* may include a database. The database may include a remote database. The database may be implemented, without limitation, as a relational database, a key-value retrieval database such as a NOSQL database, or any other format or structure for use as database that a person skilled in the art would recognize as suitable upon review of the entirety of this disclosure. The database may alternatively or additionally be implemented using a distributed data storage protocol and/or data structure, such as a distributed hash table or the like. The database may include a plurality of data entries and/or records as described above. Data entries in database may be flagged with or linked to one or more additional elements of information, which may be reflected in data entry cells and/or in linked tables such as tables related by one or more indices in a relational database. Persons skilled in the art, upon reviewing the entirety of this disclosure, will be aware of various ways in which data entries in database may store, retrieve, organize, and/or reflect data and/or records.

With continued reference to FIGS. 1A-G, system 100*a-g* may include and/or be communicatively connected to a server, such as but not limited to, a remote server, a cloud server, a network server and the like. In one or more embodiments, the computing device may be configured to transmit one or more processes to be executed by server. In one or more embodiments, server may contain additional and/or increased processor power wherein one or more processes as described below may be performed by server. For example, and without limitation, one or more processes associated with machine learning may be performed by network server, wherein data is transmitted to server, processed and transmitted back to computing device. In one or more embodiments, server may be configured to perform one or more processes as described below to allow for increased computational power and/or decreased power usage by the system computing device. In one or more embodiments, computing device may transmit processes to server wherein computing device may conserve power or energy.

Further referring to FIGS. 1A-G, system 100*a-g* may include any "computing device" as described in this disclosure, including without limitation a microcontroller, microprocessor, digital signal processor (DSP) and/or system on a chip (SoC) as described in this disclosure. System 100*a-g* may include, be included in, and/or communicate with a mobile device such as a mobile telephone or smartphone. System 100*a-g* may include a single computing device operating independently, or may include two or more computing devices operating in concert, in parallel, sequentially or the like; two or more computing devices may be included together in a single computing device or in two or more computing devices. System 100*a-g* may interface or communicate with one or more additional devices as described below in further detail via a network interface device. Network interface device may be utilized for connecting processor to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. Processor may include but is not limited to, for example, a computing device or cluster of computing devices in a first location and a second computing device or cluster of computing devices in a second location. System 100*a-g* may include one or more computing devices dedicated to data storage, security, distribution of traffic for load balancing, and the like. System 100*a-g* may distribute one or more computing tasks as described below across a plurality of computing devices of computing device, which may operate in parallel, in series, redundantly, or in any other manner used for distribution of tasks or memory between computing devices. System 100*a-g* may be implemented, as a non-limiting example, using a "shared nothing" architecture.

With continued reference to FIGS. 1A-G, processor may be designed and/or configured to perform any method, method step, or sequence of method steps in any embodiment described in this disclosure, in any order and with any degree of repetition. For instance, processor may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Processor May perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

Still referring to FIGS. 1A-G, system 100*a-g* includes a multi-axis robotic arm 102 affixed to a surface 104 at a proximal end 106. As used in this disclosure, a "multi-axis robotic arm" is a robotic apparatus that includes two or more joints or axes of movement, each configured to permit rotation or translation along a distinct degree of freedom, thereby enabling the multi-axis robotic arm 102 to position, orient, or manipulate components or tools in three-dimensional space. The multi-axis robotic arm 102 may include a combination of rotary joints (e.g., revolute joints) and linear actuators that allow articulated movement across various planes, such as pitch, yaw, and roll. In some embodiments, the multi-axis robotic arm 102 may include three to six joints, permitting complex movements such as vertical lift, radial extension, and rotational articulation. The multi-axis robotic arm 102 may be composed of lightweight and durable materials such as anodized aluminum, carbon fiber composites, or stainless steel, selected to balance structural rigidity with responsiveness. The multi-axis robotic arm 102 may be affixed to a surface 104 at a proximal end 106 using one or more mechanical fasteners, magnetic bases, or mounting brackets, and may include shock-absorbing or vibration-dampening components to stabilize its base during operation.

With continued reference to FIGS. 1A-G, the movement of the multi-axis robotic arm 102 may be actuated by a series of electric motors, servo motors, or pneumatic actuators housed within or adjacent to the joint mechanisms. The control of these motors may be coordinated through an embedded motion controller or an external computing device executing a motion-planning algorithm, which may enable precise, synchronized movement across multiple joints. In some embodiments, positional feedback may be received from encoders, torque sensors, or inertial measurement units (IMUs) integrated at each joint, allowing system 100*a-g* to perform closed-loop control and correct for drift, deflection, or external disturbances during operation. The multi-axis robotic arm 102 may be constructed from structurally resilient and lightweight materials such as anodized aluminum, stainless steel, or carbon fiber-reinforced polymer composites to provide mechanical strength, reduce vibration, and optimize load-bearing capacity. In some cases, select components of the multi-axis robotic arm 102 may be coated or surface-treated to resist wear, corrosion, or particulate contamination in industrial environments. The proximal end 106 of the multi-axis robotic arm 102 may be affixed to a surface 104, such as a frame, platform, or workstation table, using one or more attachment mechanisms. These may include threaded fasteners, base flanges, mounting brackets, magnetic bases, or quick-release clamps. The attachment interface may also incorporate shock-absorbing pads, elastomeric gaskets, or vibration-damping mounts to stabilize the multi-axis robotic arm 102 during high-speed movements or tool activations. In an embodiment, the base may further include a rotational bearing or gimbal to add an additional axis of motion or to enable repositioning of the entire structure of the multi-axis robotic arm 102. In an embodiment, multi-axis robotic arm 102 may include integrated cable routing channels or internal wiring conduits to protect electrical connections from mechanical wear and environmental exposure, preserving signal integrity and reducing clutter. The joints of the multi-axis robotic arm 102 may incorporate low-backlash gear assemblies or harmonic drives, which may improve the accuracy of fine movements and reduce mechanical hysteresis during repetitive operations.

With continued reference to FIGS. 1A-G, in some embodiments, multi-axis robotic arm 102 may include quick-swap end-effector couplings that allow for rapid replacement or reconfiguration of attached tools, such as cutting system 138, grippers, adhesive dispensers, or inspection sensors, without requiring full system disassembly. The multi-axis robotic arm 102 may also be equipped with integrated sensors, such as torque sensors at each joint to detect resistance or obstructions, or proximity sensors for safe interaction with surrounding components or operators. Additionally and/or alternatively, multi-axis robotic arm 102 may include adaptive learning algorithms or machine learning-based calibration routines that allow it to self-correct for positional drift, mechanical wear, or changing payload dynamics over time. In certain configurations, the multi-axis robotic arm 102 may be designed for collaborative operation, incorporating force-limiting joints and safety-rated control protocols to allow it to work safely alongside humans in a shared workspace. The structure itself may include 3D-printed or modular components for weight reduction, customizability, or low-volume production flexibility. Furthermore, multi-axis robotic arm 102 may integrate environmental sealing, such as IP-rated housings or positive pressure enclosures, enabling operation in cleanroom, wet, or dusty environments.

With continued reference to FIGS. 1A-G, as used in this disclosure, a "surface" is a fixed or movable physical structure, platform, frame, or base. In an embodiment, the surface 104 may allow components of the system to be mounted, attached, or secured, and upon which system 100*a-g* operates or is supported. The surface 104 may include integrated features such as threaded inserts, predrilled holes, slots, or magnetic interfaces to facilitate attachment of mechanical subsystems, such as robotic arms, axle plates, pneumatic pistons 136, sensors, or electronic enclosures. In certain configurations, the surface 104 may be modular or reconfigurable, enabling rapid changes in the layout or spatial arrangement of system 100*a-g* components. The surface 104 may also support additional functional components such as cable routing channels, ground points for electrical safety, or leveling feet to adjust orientation relative to the ground. In an embodiment, the surface 104 may be part of a movable platform or automated guided vehicle (AGV), and may further include locking mechanisms or dampening systems to stabilize system 100*a-g* during operation. Additionally and/or alternatively, the surface 104 may include one or more coatings or finishes, such as powder coating, anodization, or anti-static laminates, to enhance durability, resist corrosion, reduce contamination, or meet environmental or regulatory requirements for specific applications (e.g., cleanroom or food-safe environments). As used in this disclosure, a "proximal end" is a portion of a structure that is positioned closest to the attachment point with the surface 104 or system base. The proximal end 106 may be opposite the distal end 110 as defined herein, which is farthest from the attachment point and may interface with functional tooling or mechanisms.

Still referring to FIGS. 1A-G, system 100*a-g* includes at least a mounting axle plate 108 coupled to a distal end 110 of the multi-axis robotic arm 102, wherein the at least a mounting axle plate 108 includes a mounting axle 112 protruding from a surface 114 of the at least a mounting axle plate 108. As used in this disclosure, a "mounting axle plate" is a structural component configured to interface with and support a mounting axle 112. In an embodiment, the mounting axle plate 108 may include one or more surfaces 114 adapted for mechanical coupling to a robotic arm 102 or another structural element, and wherein the mounting axle 112 protrudes from a surface 114 of the mounting axle plate 108 to enable the rotational or fixed attachment of an adhesive roll 118 or similar component. The mounting axle plate 108 may be fabricated from a rigid material such as aluminum, stainless steel, or a reinforced polymer to ensure mechanical stability during operation and to withstand forces imparted by the rotational movement of the mounted adhesive roll 118. The mounting axle plate 108 may include integrated fastening features such as tapped holes, slots, or alignment pins to ensure precise and secure attachment to the distal end 110 of a multi-axis robotic arm 102 or other mechanical interfaces. In some embodiments, the plate may be shaped or machined to provide clearance for adjacent components, such as rollers, sensors, or cutting assemblies. The plate may also incorporate modular features or mounting patterns, allowing different types or sizes of axles to be interchangeably installed depending on the size or core dimensions of the adhesive roll 118.

With continued reference to FIGS. 1A-G, as used in this disclosure, "coupled to" is a term that refers to two or more components being joined, connected, or otherwise associated with one another, either directly or indirectly, to permit structural, mechanical, or functional interaction. The coupling may be achieved through various means including, but not limited to, mechanical fastening (e.g., bolts, screws, rivets), welding, adhesive bonding, press-fitting, clamping, magnetic attachment, or integrally formed construction. In some embodiments, "coupled to" may also encompass adjustable or removable connections that allow for repositioning or replacement of components while maintaining operational alignment or continuity. Additionally and/or alternatively, "coupled to" encompasses arrangements that allow for transmission of signals or data, such as a sensor electrically coupled to a processor via wiring or wireless communication, as well as mechanical interactions, such as a motor shaft coupled to a drive roller to transmit rotational torque.

With continued reference to FIGS. 1A-G, as used in this disclosure, a "distal end" is a portion of a structure that is positioned farthest from the attachment point to system 100*a-g* base or surface. In an embodiment, the distal end 110 may serve as the functional interface for tools, components, or mechanisms controlled by the multi-axis robotic arm 102. As used in this disclosure, a "mounting axle" is a rotatable or fixed cylindrical shaft configured to receive and support an adhesive roll 118. In an embodiment, the mounting axle 112 may be positioned to allow for rotation or dispensing of a strip 120 of adhesive during operation of system 100*a-g*. The mounting axle 112 may protrude perpendicularly or at an angle from the surface of the mounting axle plate 108, and may be secured via integrated bushings, bearings, or locking collars to allow for free rotation or controlled movement depending on the operational requirements. In certain configurations, the plate may support a quick-release or tool-less locking mechanism that enables rapid installation or removal of the adhesive roll 118 for maintenance or replacement. The mounting axle plate 108 may further include additional design elements such as stiffening ribs, recessed channels, or labeling indicators to enhance its structural performance, improve alignment accuracy, or assist in installation. In some embodiments, it may also feature sensor mounting brackets or signal routing features to support additional functionality such as monitoring roll usage, detecting roll presence, or facilitating feedback-driven motor control.

Still referring to FIGS. 1A-G, system 100*a-g* includes at least a mounting axle motor 116 coupled to the mounting axle 112 of the at least a mounting axle plate 108, wherein the at least a mounting axle motor 116 is configured to conditionally rotate the mounting axle 112 upon receipt of a system command. As used in this disclosure, a "mounting axle motor" is a motorized component mechanically coupled to a mounting axle 112 and configured to induce rotation of the mounting axle 112. In an embodiment, the mounting axle motor 116 may be configured to rotate the mounting axle 112 either continuously or intermittently, based on operational requirements. The mounting axle motor 116 may be an electric motor, such as a stepper motor, servo motor, or brushed/brushless DC motor, and may include integrated features such as torque control, positional encoding, or variable speed regulation. The motor may be mounted directly to the mounting axle plate 108 or connected via a geartrain, belt drive, or coupling mechanism. In some embodiments, the motor may also be reversibly controlled to rotate the axle in either direction for winding or unwinding a strip 120 of adhesive. As used in this disclosure, "conditionally rotate" is rotating an element based on satisfaction of one or more predetermined conditions or control signals. In an embodiment, the element may include, without limitation, an axle, shaft, motorized component, and the like. These predetermined conditions may include, for example, receiving a system command, reaching a specific position, detecting the presence of an object, or meeting a threshold value such as torque or speed. In a non-limiting example, a motor may conditionally rotate a mounting axle only when a controller determines that an adhesive dispensing cycle should begin, thereby enabling controlled and context-specific actuation. As used in this disclosure, a "system command" is an instruction or signal generated by a computing device, control processor, or programmable logic controller (PLC), which is transmitted to a subsystem, such as a motor, actuator, or sensor, to initiate, terminate, or modify an operational behavior. A system command may be triggered automatically based on sensor data, pre-programmed instructions, or user input received through a graphical user interface. In an embodiment, the system command may include instructions to rotate the axle at a defined speed, for a defined duration, or in synchronization with other system components such as a powered roller or cutting mechanism.

With continued reference to FIGS. 1A-G, In a non-limiting example, system 100*a-g* may receive a command from a computing device indicating that a new adhesive roll 118 has been loaded and must be advanced to a starting position. Upon receiving this system command, the mounting axle motor 116 may be activated to rotate the mounting axle 112 forward at a low speed until a sensor detects the leading edge of the adhesive strip 120 has reached a predefined alignment point. Once detected, the motor may stop automatically, thereby ensuring the adhesive strip 120 is properly staged for dispensing. In another non-limiting example, system 100*a-g* may include a continuous adhesive dispensing operation, where the computing device monitors the dispensing rate of the powered roller. If system 100*a-g* determines that the rotation of the powered roller is outpacing the unwind rate of the adhesive roll 118, resulting in increased tension, the computing device may issue a system command to the mounting axle motor 116 to rotate the axle incrementally. This rotation reduces tension by feeding more adhesive forward, and the motor may stop automatically once the sensor data indicates the tension is within a desired range.

Still referring to FIGS. 1A-G, system 100*a-g* includes at least an adhesive roll 118 attached to the mounting axle 112 of the at least a mounting axle plate 108, wherein the at least an adhesive roll 118 includes a strip 120 of adhesive. As used in this disclosure, an "adhesive roll" is a cylindrical component includes a wound length of adhesive material. Without limitation, the adhesive roll 118 may be formed around a central core, and configured to be mounted onto a mounting axle 112 for controlled unwinding and dispensing. The adhesive roll 118 may include a backing substrate, such as paper, plastic, or fabric, coated with a pressure-sensitive, heat-activated, or chemically-activated adhesive layer. In some embodiments, the adhesive roll 118 may vary in width, diameter, core size, or adhesive formulation depending on the application, and may be replaceable, reloadable, or modularly attached to the mounting axle 112.

With continued reference to FIGS. 1A-G, as used in this disclosure, a "strip" is a continuous or segmented length of adhesive material unwound from an adhesive roll 118. Without limitation, the strip 120 may include a backing layer coated with an adhesive substance on at least one surface. The strip 120 of adhesive may be dispensed, cut, or applied to a target surface during system operation. In some embodiments, the strip 120 of adhesive may include pre-cut segments, markers, or perforations to facilitate cutting or placement, and may be configured to bond with surfaces such as plastic, metal, cardboard, or fabric. The adhesive roll 118 may include a central cylindrical core made of cardboard, plastic, or metal, around which a continuous strip 120 of adhesive material is tightly wound. The roll may be installed by sliding it onto the mounting axle 112 and locking it in place using a clamping collar, quick-release mechanism, or friction fit. In some embodiments, the adhesive roll 118 may vary in outer diameter and width depending on the specific operational requirements, and the mounting axle plate 108 may include adjustable or modular fittings to accommodate such dimensional variation. The attachment ensures the roll is positioned for rotational unwinding as system 100*a-g* operates, with the axis of rotation aligned to allow for consistent feeding of the strip 120 of adhesive toward downstream components. The strip 120 of adhesive contained in the adhesive roll 118 may consist of a flexible backing layer, such as paper, polymer film, or foil, coated on one side with a pressure-sensitive or thermally activated adhesive. As system 100*a-g* executes a dispensing cycle, the adhesive roll 118 may rotate to unwind the strip 120 in a controlled manner. The unwound strip 120 may be routed through a tensioning system 142 and over a powered roller, which advances it toward a cutting mechanism or application zone. In some cases, the strip 120 of adhesive may include printed alignment markers, perforations, or embedded indicators that are detectable by sensors for precise cut placement. The strip 120 may be dispensed in discrete segments or as a continuous length, depending on system 100*a-g* settings and user-defined parameters. The integration of the adhesive roll 118 into system 100*a-g* allows for efficient, repeatable delivery of adhesive material with minimal manual intervention.

With continued reference to FIGS. 1A-G, the at least a mounting axle plate 108 may include a quick-release locking mechanism 122 configured to secure and release the at least an adhesive roll 118. As used in this disclosure, a "quick-release locking mechanism" is a mechanical interface integrated into or affixed to a mounting axle plate 108, configured to enable rapid and tool-less securing and releasing of an adhesive roll 118 from the mounting axle 112. The quick-release locking mechanism 122 may include one or more manually operated components such as spring-loaded latches, twist-lock collars, lever arms, cam locks, or push-button actuators that engage with the core of the adhesive roll 118 or the mounting axle 112 itself. In some embodiments, the mechanism may include detents, retaining pins, or tensioned clamps that automatically engage when the adhesive roll 118 is inserted, and may be disengaged by applying a minimal amount of force or rotating a locking element. The quick-release locking mechanism 122 may be designed to accommodate rolls of varying core diameters or widths and may include interchangeable adapters or adjustable features to ensure compatibility with different adhesive roll 118 formats. This mechanism allows an operator to efficiently remove and replace depleted rolls without requiring disassembly of the surrounding components or the use of external tools, thereby reducing system 100*a-g* downtime and facilitating maintenance or reloading operations in high-throughput environments.

With continued reference to FIGS. 1A-G, the mounting axle 112 may further include an adjustable axle fitting 124, wherein the adjustable axle fitting 124 accommodates one or more sizes associated with the at least an adhesive roll 118. As used in this disclosure, an "adjustable axle fitting" is a configurable mechanical element associated with a mounting axle 112, configured to modify or adapt the interface between the mounting axle 112 and an adhesive roll 118. Without limitation, the adjustable axle fitting 124 may be used to ensure proper alignment, securement, or rotational stability. The adjustable axle fitting 124 may include components such as telescoping sleeves, interchangeable spacers, expanding mandrels, tapered cones, or threaded collars that may be extended, compressed, or repositioned to accommodate variations in roll core diameter, width, or mounting depth. In some embodiments, the fitting may be manually adjustable or automatically actuated, and may include locking features such as clamps, detents, or set screws to fix the fitting in place once adjusted. As used in this disclosure, "sizes" is a term referring to one or more physical dimensions or geometric properties of an adhesive roll 118. The one or more physical dimensions of the adhesive roll 118 may include without limitation, the outer diameter, inner core diameter, axial width, weight, or material thickness. These sizes may vary depending on the type of adhesive material used, manufacturer specifications, or intended application, and may affect how the adhesive roll 118 is mounted, rotated, or dispensed by system 100*a-g*. The adjustable axle fitting 124 may be configured to accommodate these variable sizes to enable compatibility with a range of adhesive roll 118 formats and reduce the need for multiple dedicated axles.

With continued reference to FIGS. 1A-G, in a non-limiting example, the mounting axle 112 may include an adjustable axle fitting 124 in the form of an expanding mandrel mechanism. The mandrel may be inserted into the hollow core of an adhesive roll 118, and upon rotation of a locking knob or actuation of a cam lever, the mandrel expands radially to grip the inner surface of the core. This expansion allows system 100*a-g* to securely hold adhesive roll 118 with varying core diameters, such as 1-inch, 2-inch, or 3-inch inner diameters, without requiring separate axles for each size. Once locked in place, the adhesive roll 118 can rotate freely with the axle for dispensing, and when the roll is depleted, the mandrel can be quickly collapsed for removal and replacement with a new roll of a different size.

With continued reference to FIGS. 1A-G, system 100*a-g* may further include a housing enclosing the at least an adhesive roll 118 and the at least a mounting axle 112, the housing comprising a transparent window. As used in this disclosure, a "housing" is a structural enclosure configured to partially or fully surround and protect one or more system components. Such system components may include the adhesive roll 118 and a mounting axle 112. The housing may serve to shield internal components from environmental contaminants, physical damage, or user interference during operation. It may be constructed from materials such as plastic, metal, or composite panels, and may include access points such as hinged doors, removable panels, or latches to allow for maintenance, loading, or inspection. In some embodiments, the housing may also include integrated mounting features, ventilation openings, or seals to accommodate operational needs. As used in this disclosure, a "transparent window" is a portion of the housing comprising a clear or translucent material. Without limitation, the material may include acrylic, polycarbonate, tempered glass, and the like, and may be configured to allow visual inspection of enclosed components, such as the adhesive roll 118, without requiring removal of the housing. The transparent window may be integrated into the housing as a fixed or hinged element and may be positioned to provide visibility into critical regions of system 100*a-g*, such as roll depletion levels, adhesive alignment, or operational status. In some embodiments, the transparent window may also include optical coatings, printed indicators, or embedded sensors to enhance monitoring capabilities. Without limitation, system 100*a-g* may include a molded polycarbonate housing that fully encloses the adhesive roll 118 and mounting axle 112 to protect them from dust, debris, and accidental contact during operation. Integrated into the front face of the housing is a transparent window made of clear acrylic, positioned directly above the adhesive roll 118. This window allows an operator to visually inspect the remaining adhesive supply without opening the housing. The window may also include printed calibration lines indicating roll depletion levels and may be bordered with a rubber gasket to prevent the ingress of particulates. When the adhesive roll 118 needs replacement, the housing door, hinged at the side, can be opened, and the quick-release locking mechanism 122 inside allows the roll to be swapped out efficiently.

Still referring to FIGS. 1A-G, system 100*a-g* includes plate 130 coupled to a distal area 132 of the second surface of the at least a mounting axle plate 108, wherein the plate includes linear guide rails 134 coupled to the third surface of the plate 130, wherein the linear guide rails 134 are configured to guide a translation of the plate 130. As used in this disclosure, a "distal area" is a surface of a structural component that is positioned farthest from a proximal end of an element. In an embodiment, the distal area 132 refers to the outward-facing or opposite side from where the plate is mounted to a robotic arm 102 or base structure. This surface may serve as a mounting interface for additional components, such as plates, motors, or guide systems. As used in this disclosure, a "plate" is a rigid, flat structural component configured to serve as a mounting or support surface for one or more subsystems or mechanical elements within system 100*a-g*. The plate may be coupled to a distal area 132 of a mounting axle plate 108 and may provide a foundation for components such as linear guide rails 134, a piston 136, a cutting system 138, or a tensioning system 142. The plate may be fabricated from metal, plastic, or composite materials to provide sufficient structural integrity and dimensional stability during operation. The plate may include features such as drilled holes, threaded inserts, slots, or alignment marks to facilitate precise attachment of other components and to support modularity or reconfiguration. In some embodiments, the plate may be configured to translate along an axis defined by the linear guide rails 134, enabling attached components to move in coordination with system commands. The plate may also serve as an intermediary interface that bridges motion or functionality between upstream (e.g., mounting axle 112) and downstream (e.g., adhesive dispensing or cutting) portions of system 100*a-g*.

With continued reference to FIGS. 1A-G, as used in this disclosure, "linear guide rails" are mechanical structures affixed to a surface configured to constrain and direct motion along a defined straight path. The linear guide rails 134 may include one or more rails, grooves, or tracks along which corresponding sliders, bushings, or bearings move with reduced friction. The linear guide rails 134 may be constructed of metal, polymer, or composite materials and may be designed to provide smooth and precise linear movement under load. As used in this disclosure, "translation" is the linear movement of a component or assembly along a single axis or plane without rotation. In an embodiment, translation refers to the guided movement of the plate along the linear guide rails 134, allowing components mounted on the plate, such as a cutting system 138 or tensioning mechanism, to shift position relative to the mounting axle plate 108 during operation. In a non-limiting example, system 100*a-g* includes a secondary plate mechanically coupled to a distal area 132 of the mounting axle plate 108 using a set of standoff brackets. This secondary plate supports various downstream components, such as a cutting system 138 and a tensioning mechanism. Attached to the top surface of this plate are two parallel linear guide rails 134 aligned along a horizontal axis. Slidably mounted onto these rails is a carriage assembly, which may carry a blade 140 or adhesive applicator. During operation, the carriage assembly is translated forward and backward along the rails by an integrated pneumatic piston 136, allowing precise linear motion across the dispensing path. This guided movement ensures that components mounted on the plate remain properly aligned while transitioning between active and resting positions.

With continued reference to FIGS. 1A-G, in another non-limiting example, the plate 130 may serve as a mobile platform for adjusting the position of a powered roller and tensioning guide in response to adhesive roll 118 changes. The plate 130, mounted to the distal area 132 of the mounting axle plate 108, includes linear guide rails 134 positioned to allow axial translation along the direction of tape feed. When a new adhesive roll 118 is loaded with a different width, system 100*a-g* may translate the plate 130 along the rails to reposition the roller and tensioner accordingly. This translation may be achieved manually via a threaded adjustment knob or automatically through a motorized actuator. The linear guide rails 134 help maintain smooth and parallel motion, reducing mechanical misalignment and improving consistency in tape feed and cutting precision.

Still referring to FIGS. 1A-G, the plate 130 includes at least a piston 136 coupled to the third surface of the plate 130, wherein the at least a piston 136 is configured to power the translation of the plate 130 on the linear guide rails 134. As used in this disclosure, a "piston" is a linear actuator configured to generate mechanical force or motion along a straight path. In an embodiment, the at least a piston may generate the mechanical force by means of compressed air, hydraulic fluid, or electric drive. The at least a piston 136 includes a cylinder housing and a reciprocating rod that extends and retracts in response to pressure differentials or motor-driven displacement. When mounted to the surface of the mounting plate, the at least a piston 136 may be configured to apply controlled force to initiate and guide the translation of the plate 130 along the linear guide rails 134. In some embodiments, the at least a piston 136 may be a pneumatic cylinder that responds to system commands for automated motion control, and may include features such as adjustable stroke length, position sensors, or flow regulators to manage the speed and range of movement. In an embodiment, system 100*a-g* may include a pneumatic piston 136 mounted to the surface of the mounting plate, positioned parallel to a pair of linear guide rails 134. The at least a piston 136 includes an air-actuated cylinder with an extendable rod attached to the translating plate 130. When a system command is issued, compressed air is delivered to one end of the cylinder, causing the at least a piston 136 rod to extend and push the translating plate 130 along the guide rails. This motion may be used to drive a cutting blade 140 forward across the adhesive strip 120, severing it at a defined length. Once the cut is complete, the pneumatic system 158 may reverse airflow to retract the at least a piston 136, returning the blade 140 to its resting position. The translation occurs smoothly and consistently due to the alignment provided by the linear guide rails 134.

With continued reference to FIGS. 1A-G, in another non-limiting example, the at least a piston 136 may be electrically actuated and configured to reposition the plate 130 holding the tensioning system 142. When system 100*a-g* detects that the adhesive roll 118 is nearing depletion and slack in the strip 120 of adhesive has increased, the computing device may issue a system command to activate the at least a piston 136. The at least a piston 136 then extends slightly, translating the plate 130 forward along the linear guide rails 134 to reestablish proper tension in the strip 120. This controlled repositioning allows for continuous, precise adjustment without interrupting operation. The at least a piston 136 may include integrated sensors to confirm full extension or retraction, ensuring that translation limits are not exceeded and that the system components remain properly aligned.

Still referring to FIGS. 1A-G, the plate 130 includes at least a cutting system 138 coupled to the third surface of the plate 130, the at least a cutting system 138 comprising at least a blade 140, wherein the at least a cutting system 138 is configured to cut, using the at least a blade 140, a segment of the strip 120 of adhesive. As used in this disclosure, a "cutting system" is a mechanical assembly configured to perform a cutting operation on a strip 120 of adhesive, wherein the cutting system 138 is mounted to a surface, such as a plate 130, and includes one or more components for actuating and guiding a blade 140. The cutting system 138 may include elements such as a blade 140 holder, actuators (e.g., piston 136 or motors), positioning guides, and safety guards. The cutting system 138 may be configured to execute linear, shear, guillotine-style, or rotary cuts, depending on the desired application. In some embodiments, the cutting system 138 may operate in response to system commands and may include sensors to confirm blade 140 position, cut completion, or jam detection. As used in this disclosure, a "blade" is a sharp-edged component configured to sever material by mechanical force. In an embodiment, the blade 140 may be housed within or supported by the cutting system 138. The blade 140 may be formed of stainless steel, carbide, or another durable material capable of producing clean cuts through a strip 120 of adhesive. The blade 140 may have a straight edge, serrated edge, or rotary edge depending on the cut type, and may be actuated manually or automatically by a motor, piston 136, or lever mechanism. In some embodiments, the blade 140 may be replaceable or adjustable in position or angle.

With continued reference to FIGS. 1A-G, as used in this disclosure, a "segment" is a discrete portion of the strip 120 of adhesive that is separated from the remainder of the strip 120 by the cutting system 138. The segment may correspond to a specific length or shape of adhesive material that is cut for application, packaging, or disposal. In certain embodiments, the segment may be determined by system 100*a-g* parameters such as user-defined length, sensor input, or detected markers on the strip 120, and may vary in size or frequency based on operational needs. The cutting system 138 may be affixed directly to the movable plate 130 or mounted on a bracket that translates along with the plate 130 during operation. It may comprise a blade 140 held in a fixed or pivoting position, along with an actuation mechanism such as a pneumatic piston 136 or electric solenoid that drives the blade 140 downward or across the strip 120 of adhesive to create a clean, controlled cut. In an embodiment, the cutting system 138 may operate in coordination with the motion of the powered roller and feedback from a sensor detecting the length of the adhesive dispensed. When the strip 120 reaches a predetermined length, the computing device may issue a command that activates the cutting system 138. The blade 140 may be driven in a shearing or guillotine motion across the strip 120, producing a segment of adhesive material suitable for application. The blade 140 may retract after the cut to reset for the next cycle. The use of a precisely actuated cutting system 138 ensures repeatable segment lengths, minimizes material waste, and maintains throughput efficiency in automated dispensing workflows.

With continued reference to FIGS. 1A-G, the at least a piston 136 and the at least a cutting system 138 may include a pneumatic system 158. As used in this disclosure, a "pneumatic system" is a system that utilizes compressed air or gas to generate mechanical motion, force, or actuation of one or more components. In an embodiment, the pneumatic system 158 may include components such as an air compressor, pressure regulators, valves, tubing, and actuators (e.g., pneumatic cylinders or piston 136) configured to control and deliver pressurized air to drive linear or rotary motion. The pneumatic system 158 may be configured to extend or retract a piston 136 to translate a plate 130 along linear guide rails 134, or to actuate a blade 140 within the cutting system 138 to perform a cutting operation on a strip 120 of adhesive. The pneumatic system 158 may further include control interfaces such as solenoid valves or pressure sensors, which allow the computing device to precisely control timing, force, and stroke length of each pneumatic actuation in response to system commands. In some embodiments, the pneumatic system 158 may include exhaust ports or mufflers to manage airflow and reduce noise during operation.

Still referring to FIGS. 1A-G, the plate 130 includes at least a tensioning system 142 coupled to the third surface of the plate 130, the at least a tensioning system 142 comprising a guide roller 144, wherein the at least a tensioning system 142 is configured to apply a force to the guide roller 144 against the strip 120 of adhesive. As used in this disclosure, a "tensioning system" is a mechanical assembly configured to regulate and maintain a desired level of tension in a strip 120 of adhesive as it is dispensed through the system. The tensioning system 142 is coupled to the surface of a plate 130 and may include one or more components such as spring 146, dampers, levers, or actuators that work in conjunction with a guide roller 144 to control slack, minimize sudden strain, and ensure smooth, continuous movement of the adhesive strip 120. In some embodiments, the tensioning system 142 may be passive (e.g., spring-loaded) or active (e.g., motor- or sensor-controlled) to dynamically respond to changes in roll resistance or dispensing speed. As used in this disclosure, a "guide roller" is a rotatable cylindrical component that interfaces with the strip 120 of adhesive and directs its movement along a predetermined path. The guide roller 144 may be supported by bearings or axles and may be positioned to ensure alignment, reduce friction, and control the curvature of the strip 120 of adhesive as it travels through system 100*a-g*. The guide roller 144 may be made of low-friction or coated materials (e.g., Teflon, silicone, or rubber) to protect the adhesive surface and maintain consistent flow. As used in this disclosure, a "force" is a mechanical load or pressure applied to a component to influence its position, movement, or resistance to motion. In an embodiment, the force may be generated by a spring mechanism, pneumatic actuator, or weighted lever, and is applied to press the guide roller 144 against the strip 120 of adhesive. This applied force helps prevent slack, stabilize motion, and maintain constant contact between the roller and the adhesive strip 120 throughout operation. In a non-limiting example, the tensioning system 142 includes a spring-loaded guide roller 144 assembly mounted to a third surface of the plate 130. The guide roller 144 is connected to a pivoting arm that rotates around a fixed point on the plate 130. A compression spring 146 may be mounted between the multi-axis robotic arm and the plate 130, applying a constant force that pushes the guide roller 144 against the strip 120 of adhesive. As the adhesive roll 118 unwinds and the strip 120 advances, this spring-based tension maintains consistent pressure, preventing slack or adhesive bunching. The system may be designed so the spring 146 force is sufficient to keep the strip 120 taut without causing deformation or damage to the adhesive surface.

With continued reference to FIGS. 1A-G, in another non-limiting example, the tensioning system 142 incorporates a pneumatically actuated guide roller 144, where the roller is mounted to the end of a piston 136-driven arm. A pneumatic cylinder applies variable force based on system feedback, such as sensor input detecting tension or speed variations in the adhesive strip 120. When system 100*a-g* detects increased slack, it extends the at least a piston 136 to push the guide roller 144 forward and tighten the strip 120. Conversely, if tension exceeds a predefined threshold, the pneumatic system 158 may retract slightly to reduce pressure. This dynamic adjustment allows for more precise tension control, particularly in high-speed or variable-load dispensing operations.

Wherein the at least a tensioning system further includes at least a tension roller 156. As used in this disclosure, a "tension roller" is a rotatable cylindrical component included within a tensioning system, configured to apply or regulate mechanical tension on a moving strip of adhesive as it is dispensed. The tension roller 156 may be positioned in contact with the strip of adhesive and may be mounted on a spring-loaded, pivoting, or sliding mechanism that allows it to dynamically respond to fluctuations in tape feed rate, slack, or load resistance. In some embodiments, the tension roller 156 may rotate freely or include bearings to reduce friction, and may be composed of materials such as rubber, polyurethane, or coated metal to maintain controlled contact without damaging the adhesive surface. The tension roller 156 works in coordination with other elements of the tensioning system, such as guide rollers, spring 146, or sensors, to ensure consistent adhesive strip alignment, reduce material bunching, and prevent excessive slack or over-tensioning during operation.

With continued reference to FIGS. 1A-G, the tensioning system 142 may include at least a spring 146, wherein the at least a spring 146 applies the force to the guide roller 144. As used in this disclosure, a "spring" is a mechanical component configured to store and release elastic potential energy in response to an applied load, wherein the spring 146 is part of the tensioning system 142 and is configured to apply a force to the guide roller 144. The spring 146 may be a compression spring, extension spring, torsion spring, or flat spring, depending on the geometry and functional requirements of system 100*a-g*. When integrated into the tensioning system 142, the spring 146 exerts a continuous or variable force that urges the guide roller 144 into contact with the strip 120 of adhesive, thereby maintaining consistent tension as the strip 120 is dispensed. In some embodiments, the spring 146 may be mounted between a pivoting roller arm and a fixed anchor point on the plate 130, applying pressure by mechanical deflection as the multi-axis robotic arm moves. The stiffness and travel distance of the spring 146 may be selected to match the required force profile for maintaining adhesive strip 120 alignment and tension without causing deformation or adhesive transfer to the roller surface. The spring 146 may be mounted between a pivoting arm, on which the guide roller 144 is installed, and a fixed point on a third surface of the plate 130. As the adhesive strip 120 advances and its tension fluctuates due to changes in roll diameter or dispensing speed, the spring 146 continuously compensates by flexing or extending, thereby keeping the roller pressed against the strip 120 with a controlled amount of force. In one or more embodiments, the spring 146 may be a compression spring 146 positioned horizontally, exerting a pushing force that drives the guide roller 144 toward the adhesive strip 120. In another embodiment, the spring 146 may be a torsion spring mounted at the pivot point of a roller arm, producing rotational force to swing the multi-axis robotic arm and roller inward as needed. This spring-driven mechanism allows the tensioning system 142 to absorb slack or relieve excess tension automatically, ensuring that the adhesive strip 120 remains taut and properly aligned throughout dispensing, even during stop-start operation or variable-speed cycles.

Still referring to FIGS. 1A-G, the plate 130 includes at least a powered roller motor 148 coupled to the third surface of the plate 130, the at least a powered roller motor 148 configured to drive the strip 120 of adhesive in a forward direction. As used in this disclosure, a "powered roller motor" is a motorized component directly coupled to a roller, wherein the motor drives the roller to advance a strip 120 of adhesive along a defined path. The powered roller motor 148 may be an electric motor (e.g., stepper, DC brushless, or servo) and may include features such as variable speed control and torque feedback to regulate the rate at which the adhesive strip 120 is conveyed. As used in this disclosure, a "forward direction" is the direction of motion in which the strip 120 of adhesive is advanced from its source (e.g., the adhesive roll 118) toward downstream components or a target application point. The forward direction defines the path along which the strip 120 is intended to travel during normal dispensing operations. The motor may be mechanically linked to a cylindrical roller positioned along the adhesive strip 120's feed path. As the motor rotates the roller, friction between the roller surface and the strip 120 of adhesive causes the strip 120 to advance along the designated travel path toward downstream components such as the cutting system 138 or application point. In one embodiment, the powered roller motor 148 may be a variable-speed DC motor that enables precise control over the rate of adhesive dispensing. The motor may receive signals from the computing device to start, stop, or modulate the speed of rotation based on system feedback, such as detected strip 120 length, user input, or tension readings. The forward direction in this context refers to movement away from the adhesive roll 118 and toward the output side of system 100*a-g*, ensuring consistent delivery of the adhesive strip 120 through subsequent processing stages. The powered roller motor 148 thus plays a critical role in enabling smooth, controlled advancement of the adhesive material during automated dispensing operations.

With continued reference to FIGS. 1A-G, each of the at least a linear guide rails 134, the at least a piston 136, the at least a cutting system 138, the at least a tensioning system 142, and the at least a powered roller motor 148 is adjustably mounted to the plate 130 using a plurality of holes 150 formed in the third surface of the plate 130. As used in this disclosure, "holes" are openings or voids formed in the surface of a plate 130, wherein the plurality of holes 150 are configured to receive fasteners, pins, bolts, or alignment features that enable the adjustable mounting of components such as linear guide rails 134, a piston 136, a cutting system 138, a tensioning system 142, or a powered roller motor 148. The plurality of holes 150 may be through-holes or threaded, and may vary in diameter or pattern depending on the component being mounted. In some embodiments, the plurality of holes 150 may be arranged in a grid, linear slot, or modular pattern to allow for reconfiguration of the mounted components, enabling the system to adapt to different adhesive roll 118 sizes, cut lengths, or hardware upgrades. The plurality of holes 150 provide mechanical anchoring points that allow the components to be securely fastened while also offering flexibility for fine-tuned positioning, alignment, or later adjustments. In a non-limiting example, the linear guide rails 134 may be mounted using elongated slots that permit fine adjustments in alignment before final tightening. Similarly, the at least a piston 136 and cutting system 138 may be positioned at varying distances from the edge of the plate 130 depending on the length or type of adhesive being dispensed. The presence of multiple holes 150 across the plate 130 allows for modular reconfiguration of the system layout, making it possible to adapt to different roll sizes, adjust tensioning force, or change the position of the powered roller motor 148 without requiring a new mounting structure. This hole-based design provides both stability and adaptability, supporting efficient system 100*a-g* assembly, maintenance, and retooling. In an embodiment, as used in this disclosure, "modular reconfiguration" is the ability to rearrange, reposition, or substitute components of a system in a flexible and repeatable manner using standardized interfaces or mounting points. Without limitation, the modular reconfiguration may allow the layout of system 100*a-g* to be adapted to different operational needs, component geometries, or functional configurations without requiring permanent structural changes or custom fabrication. In a non-limiting example, modular reconfiguration may involve repositioning the powered roller motor 148 and/or tensioning system 142 by fastening them to alternative holes on a shared mounting plate 130, thereby accommodating different roll widths or adjusting mechanical forces while maintaining compatibility with the existing platform.

With continued reference to FIGS. 1A-G, as used in this disclosure, "adjustably mounted" is to secure an object to a surface in a manner that allows for selective repositioning or reconfiguration by aligning one or more mounting components. In an embodiment, the one or more mounting components may include bolts, fasteners, and the like, within a plurality of holes 150 or slots. This configuration may permit components to be relocated or reoriented along the mounting surface to achieve desired spacing, alignment, or operational geometry. In a non-limiting example, the at least a piston 136 or powered roller motor 148 may be adjustably mounted to the plate 130 by fastening it through one set of the plurality of holes 150, allowing the operator to later reposition the component by loosening the fasteners and reattaching it through a different set of holes based on system requirements.

With continued reference to FIGS. 1A-G, the plurality of plurality of holes 150 on the third surface of the plate 130 may include one or more of a grid pattern 152 and a slot pattern 154 that enables modular reconfiguration. As used in this disclosure, a "grid pattern" is an arrangement of plurality of holes 150 formed on the surface of a plate 130 in a regular, orthogonal layout, such as rows and columns spaced at uniform intervals. The grid pattern 152 is configured to provide a consistent and repeatable mounting scheme that allows various system 100*a-g* components, such as linear guide rails 134, piston 136, or motors, to be attached at different positions depending on operational requirements. The uniform spacing facilitates alignment, modularity, and interchangeability, enabling the user to reconfigure component placement without altering the underlying structure of the plate 130.

With continued reference to FIGS. 1A-G, as used in this disclosure, a "slot pattern" is a configuration of elongated openings or channels formed in the surface of a plate 130, wherein each slot is designed to allow the position of a mounted component to be adjusted continuously along the length of the slot. The slot pattern 154 enables fine-tuned alignment or repositioning of system 100*a-g* elements, such as a cutting system 138 or tensioning assembly, to accommodate variations in adhesive roll 118 size, desired cut location, or system geometry. Slots may be linear, curved, or radiused, and may be used in conjunction with bolts, T-nuts, or slide fittings to enable secure yet adjustable mounting.

With continued reference to FIGS. 1A-G, in a non-limiting example, a third surface of the plate 130 includes a grid pattern 152 of threaded plurality of holes 150 spaced 10 mm apart in both horizontal and vertical directions. This pattern allows components such as the cutting system 138 and tensioning system 142 to be mounted at a variety of discrete positions across the plate 130, depending on the size and location of the adhesive strip 120. For instance, if a narrower adhesive roll 118 is loaded into system 100*a-g*, the cutting system 138 can be repositioned inward using a different set of plurality of holes 150 in the grid, without the need for additional hardware modifications. This grid pattern 152 supports repeatable alignment and allows for quick retooling when switching between different operational configurations. In another non-limiting example, the plate 130 includes a slot pattern 154 comprising two parallel elongated slots that run along the feed direction of the adhesive strip 120. The powered roller motor 148 is mounted using fasteners that slide within these slots, enabling the operator or system 100*a-g* to finely adjust the position of the roller relative to the adhesive path. This allows precise control over roller contact pressure and strip 120 alignment. The slots accommodate components of varying size and function, and their continuous adjustability supports dynamic system 100*a-g* tuning, especially in applications requiring high precision or variable adhesive formats.

With continued reference to FIGS. 1A-G, system 100*a-g* may further include at least a computing device communicatively connected to the at least a mounting axle motor 116 and the at least a powered roller motor 148 wherein the computing device includes a memory and at least a processor communicatively connected to the memory, wherein the memory contains instructions configuring the at least a processor to receive, using the at least a processor, an input and generate an output, wherein the output is executed at the at least a mounting axle motor 116 and the at least a powered roller motor 148. As used in this disclosure, an "input" is a signal, command, or data value received by a computing device from an external source, such as a user interface, sensor, or remote system, which is used to initiate, modify, or control system operations. Inputs may include user-selected parameters (e.g., desired cut length, dispensing speed), sensor readings (e.g., roll tension, strip 120 position), or status indicators (e.g., adhesive level, component readiness). As used in this disclosure, an "output" is a signal, command, or data value generated by a computing device as a function of one or more received inputs, wherein the output is transmitted to a system component, such as a motor or actuator, to perform a physical action or system response. Outputs may include motor control signals (e.g., speed adjustment, start/stop commands), blade 140 activation triggers, or alert notifications.

With continued reference to FIGS. 1A-G, system 100*a-g* may include at least a computing device communicatively connected to the mounting axle motor 116 and the powered roller motor 148. The computing device may comprise a memory storing machine-readable instructions and at least a processor configured to execute those instructions. In operation, the processor may receive an input, such as a user-selected dispensing command or feedback from a sensor, and generate an output that is transmitted to the mounting axle motor 116 and/or the powered roller motor 148. For example, if the input indicates that system 100*a-g* is ready to begin dispensing adhesive, the processor may generate an output to initiate rotation of the mounting axle motor 116 to unwind the roll and simultaneously activate the powered roller motor 148 to advance the strip 120 of adhesive in a forward direction. This coordination enables automated, precise control of the adhesive dispensing process in response to real-time conditions or user-defined settings.

With continued reference to FIGS. 1A-G, the computing device may be further configured to generate a usage report, wherein generating the usage report includes aggregating, using the at least a processor, operational data as a function of one or more inputs received from at least a sensor communicatively connected to the at least a processor. As used in this disclosure, a "usage report" is a compiled record or digital output generated by a computing device that summarizes the performance, status, and historical activity of one or more components of system 100*a-g* over a defined period of operation. The usage report may include metrics such as the total length of adhesive dispensed, the number of segments cut, system 100*a-g* uptime, error occurrences, maintenance alerts, and other performance indicators. The report may be displayed on a graphical user interface, exported to a downstream device, or stored in memory for diagnostic, auditing, or optimization purposes. As used in this disclosure, "operational data" is any data collected, measured, or recorded during the operation of system 100*a-g*, including both real-time and cumulative metrics. Operational data may include motor run times, blade 140 activation counts, adhesive roll 118 depletion levels, cut length accuracy, roller speeds, sensor readings, system 100*a-g* error logs, and timestamps of events. This data provides insight into the functionality, efficiency, and reliability of system 100*a-g* and may be used by the computing device to generate a usage report, trigger alerts, or inform maintenance schedules. In one specific example, the computing device is configured to generate a usage report at the end of each operational shift. Throughout operation, the computing device aggregates operational data such as the total length of adhesive dispensed (e.g., 185.4 meters), the number of blade 140 activations (e.g., 1,245 cuts), motor runtime for both the mounting axle motor 116 and the powered roller motor 148 (e.g., 3 hours 42 minutes), and system 100*a-g* downtime events (e.g., two interruptions totaling 14 minutes). The device also tracks sensor-detected anomalies such as tension loss or incomplete cuts. At a defined reporting interval or upon user request via a touchscreen interface, the computing device compiles this operational data into a structured usage report. The report includes a timestamped activity log, summary statistics, and a maintenance recommendation based on the blade 140 usage count exceeding a predefined threshold. The report may be displayed directly on the GUI or exported as a PDF or CSV file to a connected downstream device for review by a technician or supervisor. This enables performance monitoring, predictive maintenance, and quality assurance in a production environment.

With continued reference to FIGS. 1A-G, as used in this disclosure, "inputs" are data values, signals, or measurements received by the computing device from one or more sensors or other data sources. In an embodiment, the one or more inputs may reflect real-time or historical operational conditions of system 100*a-g*. The inputs may include quantitative or qualitative data and are used to inform processing logic, system adjustments, or reporting functions. In a non-limiting example, inputs may include sensor-derived data such as dispensing rate, motor rotational speed, torque, tension force, adhesive consumption, positional information, system runtime duration, or environmental conditions, like temperature or humidity. Without limitation, the one or more inputs may be received by the processor and used to generate a usage report that characterizes system performance over a defined period or operational cycle.

With continued reference to FIGS. 1A-G, system 100*a-g* may further include at least a sensor communicatively connected to the at least a computing device, the sensor coupled to the strip 120 of adhesive, wherein the computing device is further configured to receive sensor data from the sensor indicating a position of the strip 120 of adhesive. As used in this disclosure, a "sensor" is a hardware component configured to detect and measure a physical property or condition associated with the strip 120 of adhesive, and to convert that measurement into an electrical signal or data stream that can be processed by a computing device. The sensor may be optical, magnetic, capacitive, ultrasonic, mechanical, or any other suitable type depending on the measured parameter. Optical sensors may include devices such as infrared sensors, laser triangulation sensors, or camera-based systems. These sensors operate based on the reflection or interruption of light and can be used to detect object presence, measure distances, or assess alignment. For instance, a laser displacement sensor may be positioned to monitor the edge of an adhesive roll 118 or detect positional shifts in a moving component. Infrared sensors may detect changes in proximity based on light absorption, and camera systems may be employed for advanced image recognition tasks, such as detecting defects, misalignment, or material inconsistencies. These types of sensors are particularly beneficial for non-contact, high-resolution monitoring. Magnetic sensors, such as Hall-effect sensors or magnetoresistive sensors, may be used to detect the position or speed of moving components that are embedded with magnets or magnetic markers. These sensors are well-suited for environments where visibility may be obstructed by dust, vibration, or mechanical components. For example, without limitation, a Hall-effect sensor may be used to detect the rotational speed of a roller shaft by counting magnetic pulses, or to identify when a component reaches a certain position within a guide track. Capacitive sensors may detect changes in capacitance between the sensor and nearby conductive materials. Capacitive sensors may be used to sense the presence or proximity of objects, measure thickness, or detect material accumulation. For example, without limitation, a capacitive sensor may be used to detect the buildup of adhesive on a roller or to confirm the presence and continuity of the adhesive strip itself. These sensors may be particularly advantageous in systems lacking a backing layer, as they provide sensitive and reliable detection of non-metallic materials such as adhesives, even when applied in thin or uneven layers. Ultrasonic sensors operate by emitting high-frequency sound waves and measuring the time it takes for the echo to return from an object. These sensors may be used to measure distances, detect fluid levels, or confirm material presence without physical contact. In systems with varying roll diameters, ultrasonic sensors can dynamically detect the roll size and enable automated reconfiguration of tensioning or cutting mechanisms. Their ability to function reliably in dusty, humid, or variable-light environments makes them ideal for industrial and process control settings where other sensor types may degrade. Mechanical sensors may include limit switches, load cells, strain gauges, or pressure transducers. These sensors provide direct physical feedback from a system component and are useful for detecting mechanical contact, force application, or tension. For instance, without limitation, a limit switch may signal when a moving component reaches an endpoint, while a load cell may measure the tension in a tape as it is dispensed. Strain gauges bonded to structural members may detect deflection, enabling real-time tension or force monitoring. These sensors are particularly useful for implementing safety limits, ensuring proper engagement, and calibrating the mechanical behavior of the system.

With continued reference to FIG. 1A-G, in an embodiment, the sensor may be mounted near or adjacent to the adhesive strip 120 to monitor characteristics such as location, movement, alignment, or presence. As used in this disclosure, "sensor data" is a set of digital or analog signals generated by a sensor in response to a detected physical condition or event. The sensor data may include real-time values, discrete states, or derived metrics such as velocity, proximity, or deviation. In the present system 100*a-g*, the sensor data may indicate positional information about the strip 120 of adhesive, such as when it reaches a cutting zone, a sensor reference mark, or a defined endpoint. As used in this disclosure, "position" is the spatial location or orientation of the strip 120 of adhesive relative to a fixed reference point or system component. The system component may include the blade 140, tensioner, or sensor array. The position may be expressed in absolute units (e.g., millimeters from a home position) or as a binary state (e.g., "present" or "not present" at a defined location). The computing device uses position information, derived from the sensor data, to time downstream actions such as blade 140 activation or motor adjustments.

With continued reference to FIGS. 1A-G, system 100*a-g* may include at least a sensor positioned adjacent to the strip 120 of adhesive and communicatively connected to the computing device. In a non-limiting example, the sensor is an optical proximity sensor mounted near the cutting zone, configured to detect the leading edge of the adhesive strip 120 as it advances. When the sensor detects the edge passing a defined point, it transmits sensor data to the computing device indicating that the strip 120 has reached the proper cutting position. Based on this positional data, the computing device triggers the cutting system 138 to activate the blade 140 and perform a precise cut, ensuring consistent segment length. In another non-limiting example, the sensor is a rotary encoder integrated with the powered roller motor 148, configured to track the rotational displacement of the roller as the adhesive strip 120 is fed forward. The encoder generates incremental sensor data corresponding to the strip 120's linear displacement, which is relayed to the computing device. The computing device continuously calculates the position of the adhesive strip 120 based on this input and compares it to predefined thresholds for tension adjustment, segment length, or roll depletion. This positional tracking allows for real-time synchronization of system components and prevents errors such as premature cutting or misalignment during dispensing.

With continued reference to FIGS. 1A-G, the computing device may be further configured to receive, using the at least a processor, the sensor data comprising a length of a strip 120 of adhesive, generate, using the at least a processor, an alert as a function of the sensor data, wherein generating the alert comprises predicting, using the at least a processor, a remaining usage time of the strip of adhesive as a function of a dispensing rate and the length of the strip of adhesive remaining, determining, using the at least a processor, that a predicted remaining usage time falls below a predefined operational window, and generating, using the at least a processor, the alert in response to the predicted remaining usage time falling below the predefined operational window, and transmit, using the at least a processor, the alert to a graphical user interface of a downstream device. As used in this disclosure, a "length" is a measurable linear dimension of the strip 120 of adhesive. In an embodiment, the length may be expressed in units such as millimeters, centimeters, inches, and the like. The length may refer to the total amount of adhesive dispensed from the roll, the current segment of adhesive being processed, or the remaining portion of the roll. Length may be determined directly by a sensor (e.g., encoder, optical detector) or calculated based on motor rotations, strip 120 speed, or time of travel. As used in this disclosure, an "alert" is a system-generated notification or signal that communicates a status condition, event, or required action to a user. The alert may be visual (e.g., displayed text, icon, or color change), auditory (e.g., beep or alarm), or tactile (e.g., vibration) and is intended to inform the user of an operational issue, such as roll depletion, tension anomaly, or maintenance need. Alerts may be generated automatically by the computing device based on comparisons between real-time operational data and predefined criteria.

As used in this disclosure, "predicted remaining usage time" is an estimated duration of time, calculated by the computing device using at least a processor, during which the adhesive material can continue to be dispensed before depletion, based on current or recent operational conditions. This prediction may be dynamically updated and is derived from real-time or historical sensor data such as dispensing rate, remaining adhesive length, system runtime, or other relevant performance parameters. In a non-limiting example, the predicted remaining usage time may be calculated by dividing the remaining length of the adhesive strip (e.g., 150 inches) by the current average dispensing rate (e.g., 2.5 inches per second), resulting in an estimated remaining usage time of 60 seconds. This value may be used to trigger alerts, schedule maintenance, or prevent dispensing interruptions. As used in this disclosure, "predefined operational window" is intended to mean a designated time interval or usage threshold established prior to system operation, during which the system is expected to perform its dispensing function without interruption or the need for material replacement. The predefined operational window may be configured based on expected production cycle durations, minimum runtime requirements, or alert buffer periods necessary to ensure uninterrupted dispensing. In a non-limiting example, the predefined operational window may be set to 15 minutes, such that if the predicted remaining usage time of the adhesive falls below 15 minutes, based on the current dispensing rate, the system may trigger a low-adhesive alert. This may allow operators to perform timely roll replacements and avoid production downtime. As used in this disclosure, a "predetermined threshold" is a predefined numeric or logical value used as a reference point in a decision-making process. In an embodiment, a predetermined threshold may represent a minimum remaining length of adhesive, a maximum segment length, or a deviation limit for system 100*a-g* operation. When the measured or calculated length of the adhesive strip 120 crosses one or more of these thresholds, system 100*a-g* may initiate a corresponding action, such as generating an alert. A "graphical user interface," as used herein, is a graphical form of user interface that allows users to interact with electronic devices. In some embodiments, GUI may include icons, menus, other visual indicators or representations (graphics), audio indicators such as primary notation, and display information and related user controls. A menu may contain a list of choices and may allow users to select one from them. A menu bar may be displayed horizontally across the screen such as pull-down menu. When any option is clicked in this menu, then the pull-down menu may appear. A menu may include a context menu that appears only when the user performs a specific action. An example of this is pressing the right mouse button. When this is done, a menu may appear under the cursor. Files, programs, web pages and the like may be represented using a small picture in a graphical user interface. For example, links to decentralized platforms as described in this disclosure may be incorporated using icons. Using an icon may be a fast way to open documents, run programs etc. because clicking on them yields instant access.

With continued reference to FIGS. 1A-G, in an embodiment, the graphical user interface and an event handler may operate together to enable seamless interaction between the user and system 100*a-g*. The GUI serves as the visual and interactive layer through which the user engages with system 100*a-g*, presenting elements such as buttons, sliders, input fields, and informational displays. The event handler, on the other hand, functions as the underlying mechanism that monitors and responds to user interactions with the GUI. For example, when a user clicks a button on the GUI to request an explanation of a concept, the event handler may detect the click event, identify its context, and trigger the appropriate processes within system 100*a-g* to generate a tailored response. This interplay may ensure dynamic and responsive system behavior, as the event handler processes various input events such as clicks, taps, keystrokes, or voice commands, and relays these inputs to the relevant system components. The GUI subsequently updates to reflect the system's responses, such as displaying output, modifying visual elements, or providing real-time feedback. Together, the GUI and event handler create an intuitive and interactive experience, bridging user actions and system functionality to achieve efficient and personalized outcomes.

With continued reference to FIGS. 1A-G, an "event handler," as used in this disclosure, is a module, data structure, function, and/or routine that performs an action in response to an event. For instance, and without limitation, an event handler may record data corresponding to user selections of previously populated fields such as drop-down lists and/or text auto-complete and/or default entries, data corresponding to user selections of checkboxes, radio buttons, or the like, potentially along with automatically entered data triggered by such selections, user entry of textual data using a keyboard, touchscreen, speech-to-text program, or the like. Event handler may generate prompts for further information, may compare data to validation rules such as requirements that the data in question be entered within certain numerical ranges, and/or may modify data and/or generate warnings to a user in response to such requirements.

With continued reference to FIGS. 1A-G, as used in this disclosure, a "visual element" is a component or feature within a system, display, or interface that conveys information through visual means. In a non-limiting example, the visual element may include text, images, icons, shapes, colors, and/or other graphical components designed to be perceived by the user. In a non-limiting example, the visual element may aid in communication, navigation, and/or interaction with system 100*a-g*. Without limitation, the visual element may be used to enhance user experience, guide behavior, and/or represent data visually in an intuitive or informative way. A visual element may include data transmitted to display device, client device, and/or graphical user interface. In some embodiments, visual element may be interacted with. For example, visual element may include an interface, such as a button or menu. In some embodiments, visual element may be interacted with using a user device such as a smartphone, tablet, smartwatch, or computer.

With continued reference to FIGS. 1A-G, in an embodiment, system 100*a-g* and or the downstream device may include a data structure. With continued reference to FIGS. 1A-G, as used in this disclosure, "data structure" is a way of organizing data represented in a specialized format on a computer configured such that the information can be effectively presented in a graphical user interface. In some cases, the data structure includes any input data. In some cases, the data structure contains data and/or rules used to visualize the graphical elements within a graphical user interface. In some cases, the data structure may include any data described in this disclosure. In some cases, the data structure may be configured to modify the graphical user interface, wherein data within the data structure may be represented visually by the graphical user interface. In some cases, the data structure may be continuously modified and/or updated by processor, wherein elements within graphical user interface may be modified as a result. In some cases, processor may be configured to transmit display device and or the downstream device the data structure. Transmitting may include, and without limitation, transmitting using a wired or wireless connection, direct, or indirect, and between two or more components, circuits, devices, systems, and the like, which allows for reception and/or transmittance of data and/or signal(s) therebetween. Data and/or signals there between may include, without limitation, electrical, electromagnetic, magnetic, video, audio, radio, and microwave data and/or signals, combinations thereof, and the like, among others. Processor may transmit the data described above to a database wherein the data may be accessed from the database. Processor may further transmit the data above to a display device, client device, or another computing device. The data structure may serve as the organizational framework that stores, retrieves, and manages data required for processing events and updating the GUI. The data structure may act as a bridge between the user's input, captured by the event handler, and the output displayed on the GUI, ensuring that information is handled efficiently and accurately throughout the interaction. For example, without limitation, when a user interacts with a dropdown menu in the GUI to select a topic, the event handler may capture this input and accesses a data structure. The data structure may retrieve the relevant information such as, text explanations, videos, or interactive exercises, and passes it back to the event handler, which may then trigger the appropriate updates to the GUI. In another embodiment, the data structure may also maintain the state of system 100*a-g*, tracking user progress, preferences, and session history. For instance, without limitation, a hash table may store user specific configurations which the event handler references when processing interactions. The GUI may then dynamically adapt to display content aligned with these configurations. This integration may ensure that user inputs are seamlessly translated into meaningful system outputs, with the data structure enabling rapid access, consistency, and scalability throughout the process. As used in this disclosure, a "hash table" is a data structure that stores data in a way that allows for fast retrieval, insertion, and deletion of elements. The hash table may organize data into key-value pairs, where each key is unique and used to identify its corresponding value. A hash table may use a hash function to compute an index, or hash code, from the key, which determines where the key-value pair is stored within an array or list.

With continued reference to FIGS. 1A-G, as used in this disclosure, an "interactive element" is a component or feature within a graphical user interface (GUI) that allows users to perform actions, provide input, or engage with system 100*a-g*. Interactive elements may be designed to facilitate two-way communication between the user and system 100*a-g*, enabling the user to influence the behavior of the apparatus or obtain feedback in response to their actions. Examples of interactive elements may include buttons, dropdown menus, sliders, checkboxes, input fields, and hyperlinks. More advanced interactive elements may include drag-and-drop interfaces, interactive diagrams, or dynamically updating content areas that respond to user actions in real time. The interactive elements may enhance user engagement by providing intuitive and responsive mechanisms for interacting with system 100*a-g*. Interactive elements may operate by responding to user actions such as clicks, taps, swipes, or keyboard inputs, and triggering predefined system 100*a-g* behaviors or processes. The execution of the interactive elements may require a combination of front-end and back-end technologies that work together to provide seamless functionality and user interaction. On the front end, technologies such as HTML and CSS may define the structure, appearance, and layout of the interactive elements, while JavaScript may enable dynamic functionality. For example, without limitation, JavaScript may detect when the user clicks a button and trigger actions or animations. Front-end frameworks like React, Angular, or Vue.js may further enhance development by offering reusable components and efficient rendering mechanisms. On the back end, system 100*a-g* may process the user's input, retrieve the necessary data, and communicate with the front end to provide an appropriate response. APIs may act as a bridge between the front end and back end, facilitating data transfer, such as sending a user's form submission to the server and retrieving processed results. Server-side logic, implemented using languages like Python, Java, or Node.js, may handle input processing and return relevant data. Additional supporting technologies may ensure the smooth operation of interactive elements. Event listeners, for instance, may continuously monitor for specific actions like mouse clicks or text entries, executing code when such events are detected. Efficient data structures, such as hash tables or dictionaries, may store interactive state data, such as user preferences or settings, for quick access and updates. Databases, including MySQL or MongoDB, may manage and store the data required for interactive features, such as user profiles or historical activity. Communication technologies may also help maintain the responsiveness of interactive elements. AJAX (Asynchronous JavaScript and XML) may allow the front end to update portions of a web page without requiring a full page reload, enhancing responsiveness. WebSockets may provide real-time interaction capabilities, such as live chats or collaborative tools, by enabling persistent communication between the client and the server. Without limitation, system 100*a-g* may include one or more APIs. As used in this disclosure, an "application programming interface (API)" is a set of defined protocols, tools, and methods that allow different software applications, systems, or components to communicate and interact with each other. An API may act as an intermediary that enables a client application, such as a user-facing app, to send requests to a server or service and receive the necessary responses, facilitating seamless integration and functionality across diverse systems.

With continued reference to FIGS. 1A-G, as used in this disclosure, "downstream device" is a device that accesses and interacts with system 100*a-g*. For instance, and without limitation, downstream device may include a remote device and/or system 100*a-g*. In a non-limiting embodiment, downstream device may be consistent with a computing device as described in the entirety of this disclosure. Without limitation, the downstream device may include a display device. As used in this disclosure, a "display device" refers to an electronic device that visually presents information to the entity. In some cases, display device may be configured to project or show visual content generated by computers, video devices, or other electronic mechanisms. In some cases, display device may include a liquid crystal display (LCD), a cathode ray tube (CRT), a plasma display, a light emitting diode (LED) display, and any combinations thereof. In a non-limiting example, one or more display devices may vary in size, resolution, technology, and functionality. Display device may be able to show any data elements and/or visual elements as listed above in various formats such as, textural, graphical, video among others, in either monochrome or color. Display device may include, but is not limited to, a smartphone, tablet, laptop, monitor, tablet, and the like. Display device may include a separate device that includes a transparent screen configured to display computer generated images and/or information. In some cases, display device may be configured to present a graphical user-interface (GUI) to a user, wherein a user may interact with a GUI. In some cases, a user may view a GUI through display. Additionally, or alternatively, processor be connected to display device. In one or more embodiments, transmitting the alert may include displaying the alert at display device using a visual interface. As used in this disclosure, a "user" is a human operator, technician, or individual who interacts with or oversees the operation of the system. The user may receive alerts, input configuration parameters, initiate commands, or perform maintenance in response to system feedback. Alerts and other system information may be transmitted to the user via a graphical user interface on a downstream device such as a touchscreen panel, tablet, or computer.

With continued reference to FIGS. 1A-G, the computing device may be further configured to dynamically adjust a speed of at least a mounting axle motor and at least a powered roller motor 148 based on feedback, wherein the computing device is configured to receive, using at least a processor, the feedback associated with at least a dispensing rate, analyze, using the at least a processor, the feedback to determine a deviation from one or more target parameters, and generate, using the at least a processor, one or more control signals to the mounting axle motor and the powered roller motor 148 to modify the speeds as a function of the deviation. As used in this disclosure, "dynamically adjust" is to automatically modify one or more operational parameters in real time or near real time based on received feedback data. In an embodiment, the dynamic adjustment may be done without requiring manual intervention. The dynamic adjustment may be responsive to changes in system conditions, performance metrics, or deviations from target values, and is executed by a control system or processor to maintain or optimize desired performance. In a non-limiting example, the computing device may dynamically adjust the speed of the mounting axle motor and the powered roller motor by continuously monitoring the adhesive dispensing rate and comparing it to a target dispensing rate. If a deviation is detected, such as a slowdown due to adhesive drag or acceleration due to tension loss, the processor may generate control signals that increase or decrease motor speeds accordingly, thereby maintaining consistent system output. As used in this disclosure, "target operational parameters" are predetermined values or ranges associated with one or more system performance metrics that define optimal or intended functioning of the system. The target operational parameters may serve as reference points against which real-time sensor data or system behavior may be compared to detect deviations, trigger adjustments, or maintain performance consistency. In a non-limiting example, target operational parameters may include a desired dispensing rate of 2.5 inches per second, a motor speed of 1200 RPM, or a tape tension force of 1.8 newtons. System 100*a-g* may continuously monitor actual values relative to these targets, and if a deviation is detected, such as a drop in dispensing rate, the processor may adjust motor speeds or activate control mechanisms to restore operation to the desired target range.

With continued reference to FIGS. 1A-G, as used in this disclosure, "speed" is the rate at which a mechanical component rotates or moves. In an embodiment, the speed may be measured in revolutions per minute (RPM), linear distance per unit time (e.g., mm/s), or another unit reflecting temporal motion. In an embodiment, speed refers to how quickly each motor turns to rotate the adhesive roll 118 or advance the strip 120 of adhesive through system 100*a-g*. As used in this disclosure, "feedback" is any information, including sensor feedback, system state data, or derived performance metrics, returned to the computing device during or after an operation. Feedback may be used to evaluate whether system 100*a-g* is operating within acceptable limits and to support closed-loop control functions such as speed adjustments, error correction, or output regulation. As used in this disclosure, a "dispensing rate" is the speed or rate at which the strip 120 of adhesive is delivered or fed through system 100*a-g*. In an embodiment, the dispensing rate may be measured in linear units per time (e.g., mm/s or inches per minute), and the like. The dispensing rate may be influenced by the rotation of the powered roller motor 148 and may vary depending on system demand or user-defined settings. As used in this disclosure, a "deviation" is a difference or variance between a measured or observed system 100*a-g* parameter and a corresponding target parameter. For example, if the actual dispensing rate is slower than the expected rate, the difference constitutes a deviation. Deviation may be quantified in magnitude and direction and may trigger a corrective response from the computing device. As used in this disclosure, "target parameters" are predefined or dynamically generated reference values that represent desired system conditions or performance metrics. These may include target dispensing rates, motor speeds, tension levels, or positional thresholds. The computing device compares incoming feedback against these target parameters to determine whether adjustments are needed. As used in this disclosure, a "control signal" is an electrical or digital command generated by the computing device and transmitted to a system 100*a-g* component, such as a motor or actuator, to alter its operation. Control signals may adjust speed, direction, torque, or timing of movement and may be issued in response to a detected deviation from one or more target parameters. In a non-limiting example, system 100*a-g* may monitor real-time sensor feedback associated with the dispensing rate of the adhesive strip 120. This feedback may include data such as the linear speed of the strip 120, the torque applied to the roller, or positional readings from encoders. The computing device receives this feedback and analyzes it to determine whether the actual dispensing rate deviates from one or more predefined target parameters, such as a specified feed rate or tension threshold. When a deviation is detected, the computing device may respond by generating one or more control signals that are transmitted to the mounting axle motor and/or powered roller motor 148. These control signals may modify the motor speeds, either by increasing, decreasing, or modulating rotation, to bring the dispensing rate back in line with the target parameters. For example, without limitation, if the strip 120 is advancing too slowly due to increased roll resistance, the computing device may increase the speed of the mounting axle motor to unwind more material. Conversely, if the strip 120 is moving too quickly and losing tension, the powered roller motor 148 may be slowed to correct the imbalance. This dynamic adjustment allows system 100*a-g* to maintain consistent performance, reduce the risk of misalignment or slack, and optimize adhesive delivery accuracy in real time.

With continued reference to FIGS. 1A-G, the output generated by the computing device may include one or more of speed commands and blade activation signals wherein the speed commands are configured to control a rotational speed of at least a motor associated with the at least a mounting axle and wherein the blade activation signals are configured to trigger the at least a cutting system 138 to sever the strip 120 of adhesive at a designated length based on one or more operational criteria. As used in this disclosure, "speed commands" are control outputs generated by a computing device that instruct one or more motors to operate at a specific speed. These commands may be digital or analog signals transmitted to a motor controller or driver and are configured to control parameters such as acceleration, deceleration, or steady-state speed. In an embodiment, speed commands are used to regulate the rotational speed of motors associated with the mounting axle and powered roller, thereby controlling the rate at which the adhesive roll 118 unwinds and the strip 120 of adhesive advances. As used in this disclosure, "blade activation signals" are control outputs generated by the computing device that initiate the actuation of a cutting system 138. These signals may be used to energize a solenoid, activate a pneumatic piston 136, or otherwise drive a mechanical blade 140 to sever the strip 120 of adhesive. Blade activation signals are issued based on a set of timing or positional conditions and ensure that the adhesive strip 120 is cut precisely in accordance with system logic. As used in this disclosure, "rotational speed" is the rate at which a motor shaft or axle rotates around its axis. In an embodiment, the rotational speed may be measured in revolutions per minute (RPM), and the like. In an embodiment, rotational speed determines how quickly the mounting axle unwinds the adhesive roll 118 or how rapidly the powered roller advances the strip 120 of adhesive, directly affecting the dispensing rate. As used in this disclosure, a "designated length" is a predetermined or dynamically computed length of the strip 120 of adhesive that is intended to be dispensed and cut during system 100*a-g* operation. The designated length may be based on user input, system 100*a-g* settings, or product-specific requirements, and serves as a trigger condition for blade activation. As used in this disclosure, "operational criteria" are one or more conditions, thresholds, or logical rules used by the computing device to govern the timing and execution of system actions. These criteria may include time intervals, measured strip 120 lengths, sensor readings, system 100*a-g* states, or other process parameters. For example, the computing device may trigger a blade activation signal when a designated length has been reached and system tension is within acceptable limits, ensuring accurate and reliable cutting.

With continued reference to FIGS. 1A-G, the at least a piston 136 may exert a variable force based on positional feedback from the computing device. As used in this disclosure, a "variable force" is a mechanical force applied by a component that is adjustable in magnitude during system 100*a-g* operation. The force may be modulated in response to real-time conditions, commands from the computing device, or other system inputs. In an embodiment, the variable force may be applied to control the translation of a plate 130 or to adjust the contact pressure of a roller or blade 140. The magnitude of the force may change depending on factors such as strip 120 tension, adhesive thickness, or operational phase (e.g., cutting vs. standby). As used in this disclosure, "positional feedback" is information received by the computing device that indicates the current position or displacement of a movable system component, such as a plate 130, piston 136 rod, or guide roller 144. This feedback may be generated by sensors such as encoders, linear potentiometers, or limit switches, and may be used to determine the distance a component has moved, whether it has reached its intended endpoint, or whether adjustment is required. In an embodiment, the positional feedback enables the computing device to monitor the at least a piston 136 extension or retraction and dynamically regulate the force being exerted to ensure proper alignment, contact, or actuation based on system requirements.

With continued reference to FIGS. 1A-G, system 100*a-g* may further include at least a display configured generate, using the at least a processor, a system status condition as a function of one or more of sensor data and an operational threshold. As used in this disclosure, a "display" is an electronic visual interface configured to present graphical or textual information to a user, wherein the display is operatively connected to a computing device and may include components such as an LCD, LED, OLED, touchscreen panel, or other visual output unit. The display may be mounted on the system housing, integrated into a control panel, or accessible through a downstream device such as a mobile phone, tablet, or computer. The display is configured to visually present real-time system information, alerts, settings, or operational data generated by the processor. As used in this disclosure, a "system status condition" is an indicator or report that reflects the current operational state of the system or one of its components. A system status condition may be binary (e.g., "Ready" or "Not Ready"), categorical (e.g., "Running," "Paused," "Maintenance Required"), or quantitative (e.g., adhesive remaining: 12.4 meters). These conditions are generated based on input and feedback from system sensors, user inputs, or internal logic, and are used to inform the user of the machine's current state, performance, or need for attention. In a non-limiting example, the display is a touchscreen interface mounted on the front panel of the system. When system 100*a-g* is fully operational, the display shows a green "Ready" status condition along with real-time metrics such as the current cut length, dispensing speed, and adhesive roll 118 status. If a sensor detects that the adhesive roll 118 is nearly depleted, the system condition automatically changes to "Low Adhesive," and a yellow warning icon appears on the display along with a prompt to load a new roll. In another non-limiting example, the display may be wirelessly connected to a mobile app that receives data from the computing device of system 100*a-g*. The app may present a dashboard view showing the status condition as "Running—24.6 meters dispensed." If system 100*a-g* detects a blade 140 jam or tensioning fault, the system status condition changes to "Error—Blade Jam Detected," and the display provides a timestamped log entry along with suggested corrective actions. This enables the user to monitor and respond to the system's condition remotely in real time.

As used in this disclosure, "operational threshold" is a predefined limit or boundary value associated with a system parameter, beyond which the system may initiate a control response, generate a status alert, or trigger a change in operation. The operational threshold may be used by the computing device or processor to assess whether a particular sensor reading or operational condition remains within acceptable bounds during system execution. In a non-limiting example, an operational threshold may include a maximum allowable motor speed, such as 1500 RPM, beyond which the processor generates a warning signal. Another example may be a minimum dispensing rate threshold, such as 1.0 inch per second, where a drop below the threshold may indicate tape feed obstruction or depletion. Additional operational thresholds may include, without limitation, temperature limits, adhesive roll diameter limits, or tension force ranges that ensure safe and consistent dispensing.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

Figure 2:
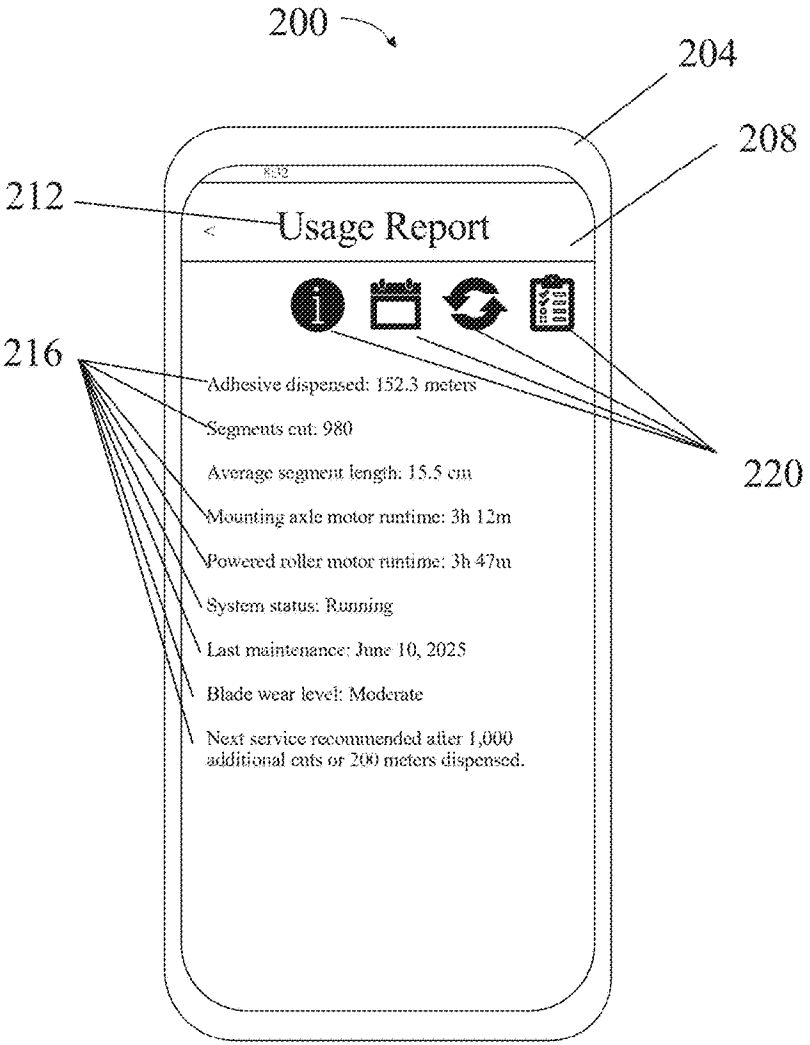
FIG. 2 is an exemplary illustration of a graphical user interface.

Referring now to FIG. 2, an exemplary illustration 200 of a graphical user interface. In an embodiment, the illustration 200 may include a downstream device 204. In an embodiment, the downstream device may include a graphical user interface 208. In an embodiment, the graphical user interface 208 may include usage report 212 which may be the same or substantially similar to the usage report as described in FIGS. 1A-G. Without limitation, the usage report 212 may be generated by the computing device as a function of aggregated operational data collected from various components of the system, such as the mounting axle motor, powered roller motor, cutting system, and tensioning system, during adhesive dispensing operations. In an embodiment, the usage report 212 may include a plurality of data 216. The plurality of data 216 may include, without limitation, the total length of adhesive dispensed, the number of segments cut, blade activation counts, motor runtime durations, system errors or alerts, and adhesive roll depletion levels. The report may be displayed on a local system interface or exported to a downstream device in a structured format (e.g., CSV, PDF, or JSON). Additionally and/or alternatively, the usage report 212 may include timestamped logs of key events such as roll changes, maintenance alerts, or system resets, and may be configured to support predictive maintenance, quality control, or production analytics. In an embodiment, the graphical user interface 208 may include one or more buttons 220. In an embodiment, the one or more buttons 220 may include an information icon, a calendar icon, a refresh icon, a checklist icon, and the like. The information icon may be configured to display a summary or detailed explanation of key system metrics included in the usage report 212, such as adhesive dispensed, blade activations, and motor runtime. When selected, this information icon may open a pop-up window or overlay that provides definitions, units of measurement, and explanations for each tracked metric. The calendar icon may be configured to allow the user to filter the usage report 212 by date range. For example, when the calendar icon is selected, the user may view operational data for specific days, weeks, or production cycles, enabling review of system performance over time and supporting quality control and historical analysis. The refresh icon may be configured to update the usage report 212 with the most current operational data. Upon selection of the refresh icon, the computing device may retrieve the latest sensor feedback and system state data, re-aggregate the results, and regenerate the displayed usage report for real-time monitoring. The checklist icon may be configured to display system alerts or a log of completed and pending maintenance tasks. When the checklist icon is activated, it may expand a panel showing timestamped entries of roll changes, blade replacements, or system resets logged in the usage report 212, supporting predictive maintenance and technician workflow tracking.

Figure 3:
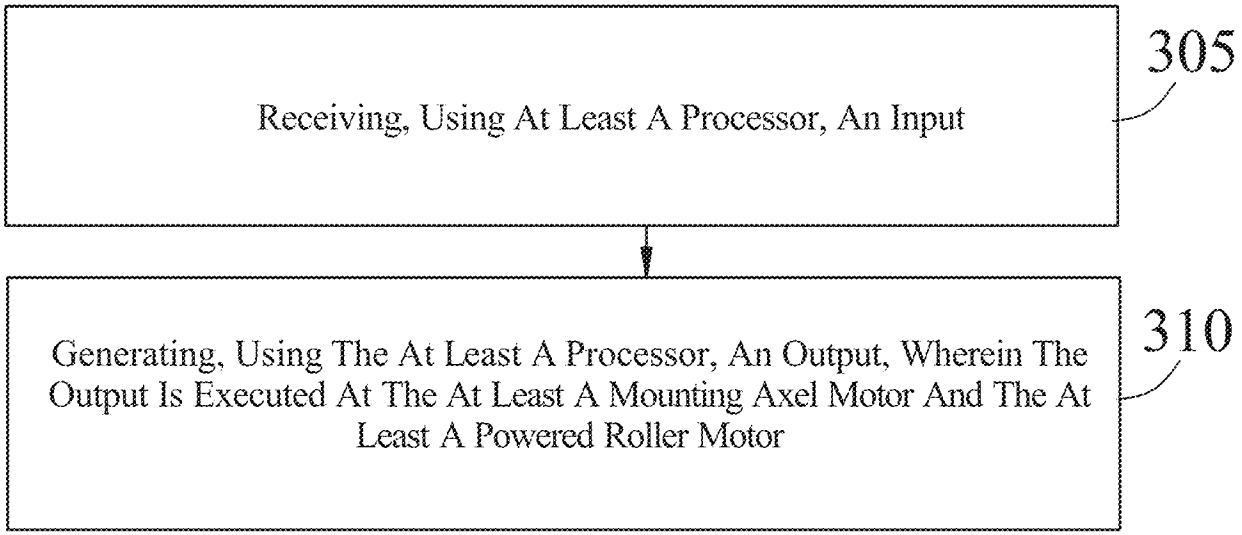
FIG. 3 is a block diagram of an exemplary method for automated tape dispensing.

Referring now to FIG. 3, a flow diagram of an exemplary method 300 for automated tape dispensing. At step 305, method 300 includes receiving, using at least a processor, an input. This may be implemented as described and with reference to FIGS. 1A-1G.

Still referring to FIG. 3, at step 310, method 300 includes generating, using the at least a processor, an output, wherein the output is executed at the at least a mounting axle motor and the at least a powered roller motor, wherein the output comprises one or more control signals configured to adjust a rotational speed of the mounting axle motor and the powered roller motor as a function of the input. This may be implemented as described and with reference to FIGS. 1A-1G.

Figure 4:
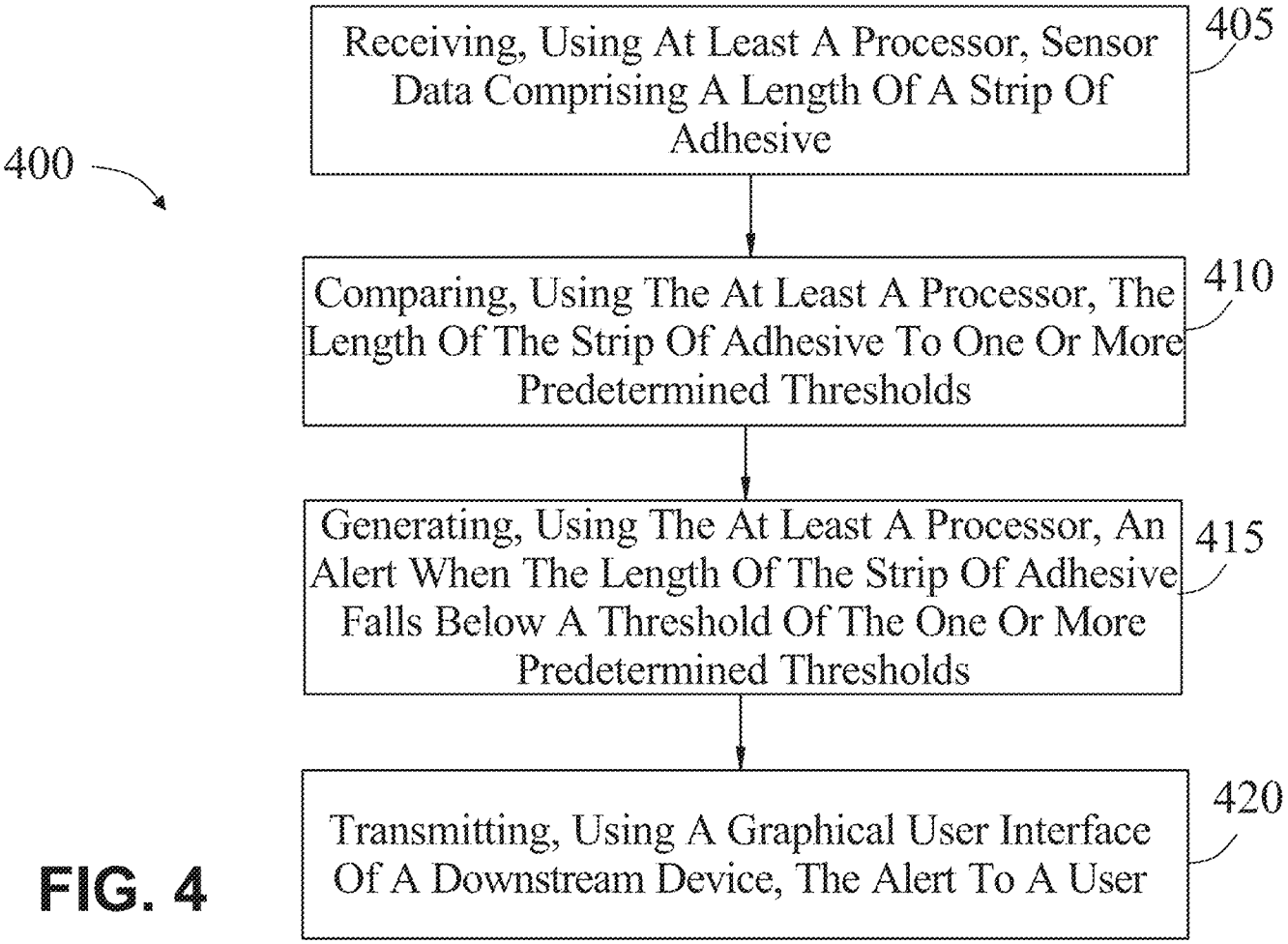
FIG. 4 is a block diagram of an exemplary method for monitoring adhesive usage in an automated tape dispensing system.

Referring now to FIG. 4, a flow diagram of an exemplary method 400 for monitoring adhesive usage in an automated tape dispensing system; At step 405, method 400 includes receiving, using at least a processor, sensor data comprising a length of a strip of adhesive. This may be implemented as described and with reference to FIGS. 1A-1G.

Still referring to FIG. 4, at step 410, method 400 includes comparing, using the at least a processor, the length of the strip of adhesive to one or more predetermined thresholds. This may be implemented as described and with reference to FIGS. 1A-1G.

Still referring to FIG. 4, at step 415, method 400 includes generating, using the at least a processor, an alert when the length of the strip of adhesive falls below a threshold of the one or more predetermined thresholds. This may be implemented as described and with reference to FIGS. 1A-1G.

Still referring to FIG. 4, at step 420, method 400 includes transmitting, using a graphical user interface of a downstream device, the alert to a user. This may be implemented as described and with reference to FIGS. 1A-1G.

Figure 5:
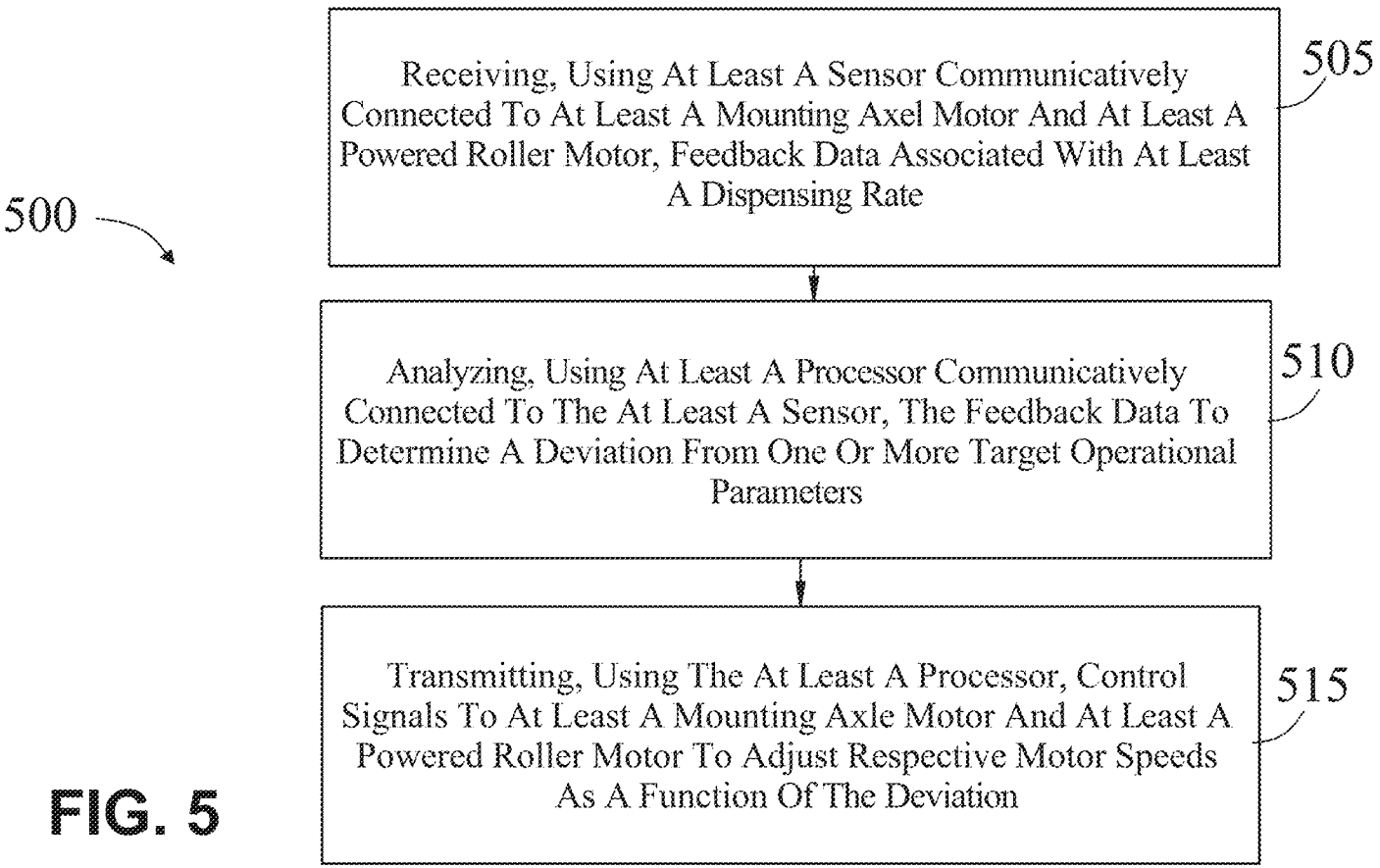
FIG. 5 is a block diagram of an exemplary method for dynamically adjusting motor speeds in an automated tape dispensing system.

Referring now to FIG. 5 a flow diagram of an exemplary method 500 for dynamically adjusting motor speeds in an automated tape dispensing system; At step 505, method 500 includes receiving, using at least a sensor communicatively connected to at least a mounting axle motor and at least a powered roller motor, feedback data associated with at least a dispensing rate. This may be implemented as described and with reference to FIGS. 1A-1G.

Still referring to FIG. 5, at step 510, method 500 includes analyzing, using at least a processor communicatively connected to the at least a sensor, the feedback data to determine a deviation from one or more target operational parameters. This may be implemented as described and with reference to FIGS. 1A-1G.

Still referring to FIG. 5, at step 515, method 500 includes transmitting, using the at least a processor, control signals to at least a mounting axle motor and at least a powered roller motor to adjust an axle motor speed and a power roller motor speed as a function of the deviation. This may be implemented as described and with reference to FIGS. 1A-1G.

Figure 6:
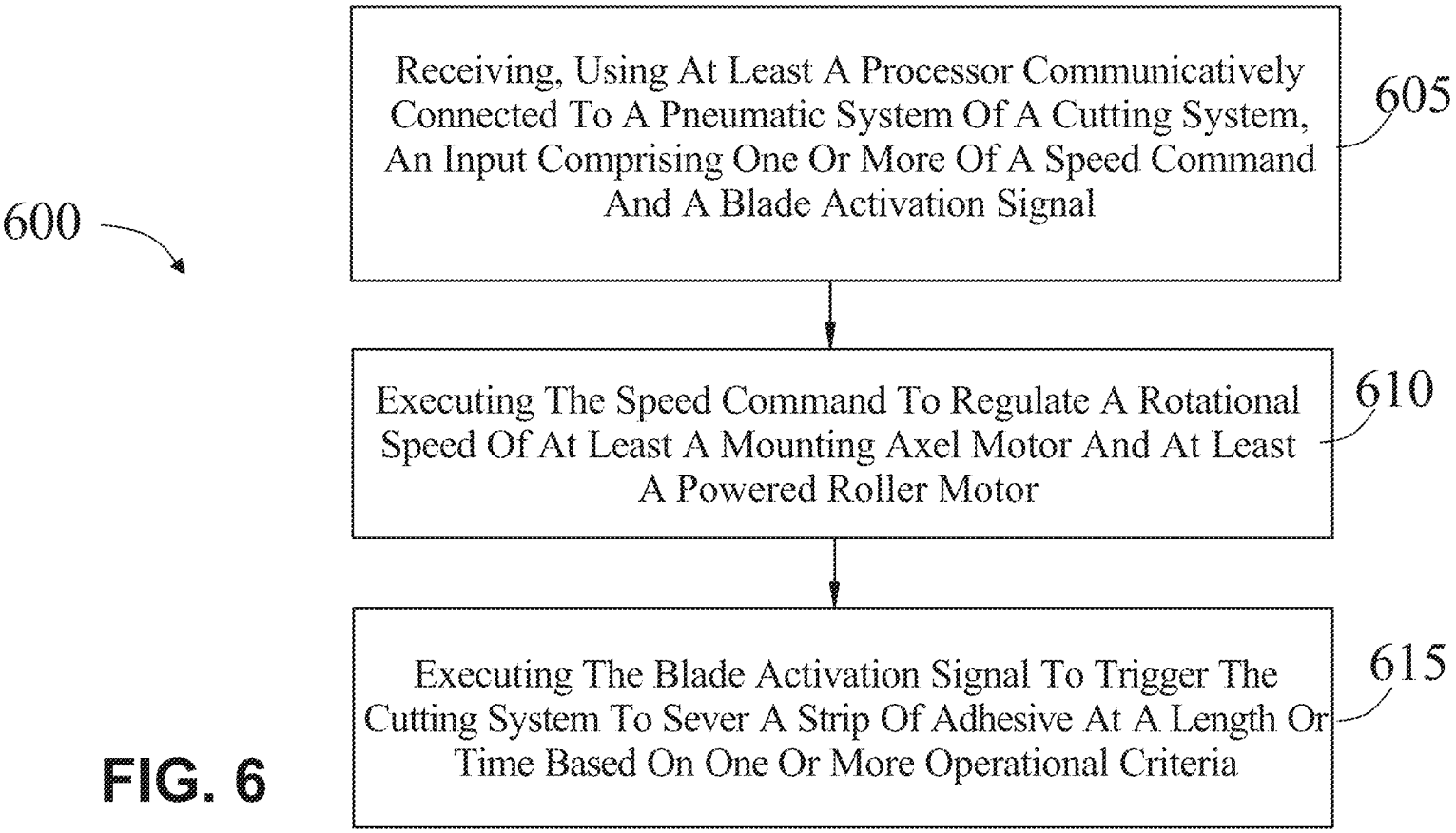
FIG. 6 is a block diagram of an exemplary method for controlling output signals in an automated tape dispensing system.

Referring now to FIG. 6 is a block diagram of an exemplary method 600 for controlling output signals in an automated tape dispensing system; At step 605, method 600 includes receiving, using at least a processor communicatively connected to a pneumatic system of a cutting system, an input comprising one or more of a speed command and a blade activation signal. This may be implemented as described and with reference to FIGS. 1A-1G.

Still referring to FIG. 6, at step 610, method 600 includes executing the speed command to regulate a rotational speed of at least a mounting axle motor and at least a powered roller motor. This may be implemented as described and with reference to FIGS. 1A-1G.

Still referring to FIG. 6, at step 615, method 600 includes executing the blade activation signal to trigger the cutting system to sever a strip of adhesive at a length or time based on one or more operational criteria. This may be implemented as described and with reference to FIGS. 1A-1G.

It is to be noted that any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In a non-limiting example, a computing device may include and/or be included in a kiosk.

Figure 7:
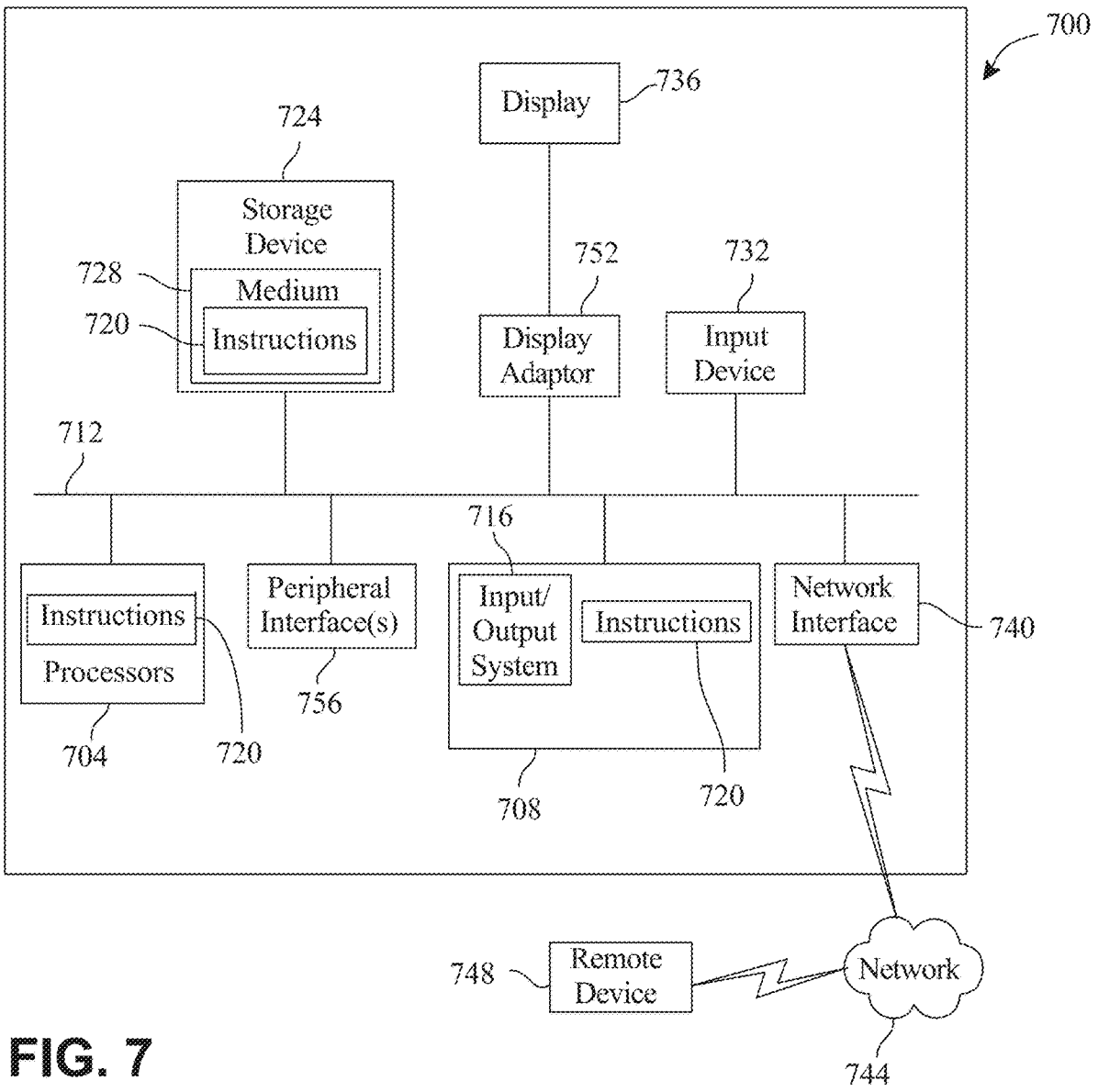
FIG. 7 is a block diagram of a computing system that can be used to implement any one or more of the methodologies disclosed herein and any one or more portions thereof.

FIG. 7 shows a diagrammatic representation of one embodiment of computing device in the exemplary form of a computer system 700 within which a set of instructions for causing a control system to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 700 includes a processor 704 and a memory 708 that communicate with each other, and with other components, via a bus 712. Bus 712 may include any of several types of bus structures including, but not limited to, a memory bus, a memory controller, a peripheral bus, a local bus, and any combinations thereof, using any of a variety of bus architectures.

Processor 704 may include any suitable processor, such as without limitation a processor incorporating logical circuitry for performing arithmetic and logical operations, such as an arithmetic and logic unit (ALU), which may be regulated with a state machine and directed by operational inputs from memory and/or sensors; processor 704 may be organized according to Von Neumann and/or Harvard architecture as a non-limiting example. Processor 704 may include, incorporate, and/or be incorporated in, without limitation, a microcontroller, microprocessor, digital signal processor (DSP), Field Programmable Gate Array (FPGA), Complex Programmable Logic Device (CPLD), Graphical Processing Unit (GPU), general purpose GPU, Tensor Processing Unit (TPU), analog or mixed signal processor, Trusted Platform Module (TPM), a floating point unit (FPU), system on module (SOM), and/or system on a chip (SoC).

Memory 708 may include various components (e.g., machine-readable media) including, but not limited to, a random-access memory component, a read only component, and any combinations thereof. In a non-limiting example, a basic input/output system 716 (BIOS), including basic routines that help to transfer information between elements within computer system 700, such as during start-up, may be stored in memory 708. Memory 708 may also include (e.g., stored on one or more machine-readable media) instructions (e.g., software) 720 embodying any one or more of the aspects and/or methodologies of the present disclosure. In another non-limiting example, memory 708 may further include any number of program modules including, but not limited to, an operating system, one or more application programs, other program modules, program data, and any combinations thereof.

Computer system 700 may also include a storage device 724. Examples of a storage device (e.g., storage device 724) include, but are not limited to, a hard disk drive, a magnetic disk drive, an optical disc drive in combination with an optical medium, a solid-state memory device, and any combinations thereof. Storage device 724 may be connected to bus 712 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In a non-limiting example, storage device 724 (or one or more components thereof) may be removably interfaced with computer system 700 (e.g., via an external port connector (not shown)). Particularly, storage device 724 and an associated machine-readable medium 728 may provide nonvolatile and/or volatile storage of machine-readable instructions, data structures, program modules, and/or other data for computer system 700. In a non-limiting example, software 720 may reside, completely or partially, within machine-readable medium 728. In another non-limiting example, software 720 may reside, completely or partially, within processor 704.

Computer system 700 may also include an input device 732. In a non-limiting example, a user of computer system 700 may enter commands and/or other information into computer system 700 via input device 732. Examples of an input device 732 include, but are not limited to, an alphanumeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 732 may be interfaced to bus 712 via any of a variety of interfaces (not shown) including, but not limited to, a serial interface, a parallel interface, a game port, a USB interface, a FIREWIRE interface, a direct interface to bus 712, and any combinations thereof. Input device 732 may include a touch screen interface that may be a part of or separate from display device 736, discussed further below. Input device 732 may be utilized as a user selection device for selecting one or more graphical representations in a graphical interface as described above.

A user may also input commands and/or other information to computer system 700 via storage device 724 (e.g., a removable disk drive, a flash drive, etc.) and/or network interface device 740. A network interface device, such as network interface device 740, may be utilized for connecting computer system 700 to one or more of a variety of networks, such as network 744, and one or more remote devices 748 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 744, may employ a wired and/or a wireless mode of communication. In general, any network topology may be used. Information (e.g., data, software 720, etc.) may be communicated to and/or from computer system 700 via network interface device 740.

Computer system 700 may further include a video display adapter 752 for communicating a displayable image to a display device, such as display device 736. Examples of a display device include, but are not limited to, a liquid crystal display (LCD), a cathode ray tube (CRT), a plasma display, a light emitting diode (LED) display, and any combinations thereof. Display adapter 752 and display device 736 may be utilized in combination with processor 704 to provide graphical representations of aspects of the present disclosure. In addition to a display device, computer system 700 may include one or more other peripheral output devices including, but not limited to, an audio speaker, a printer, and any combinations thereof. Such peripheral output devices may be connected to bus 712 via a peripheral interface 756. Examples of a peripheral interface include, but are not limited to, a serial port, a USB connection, a FIREWIRE connection, a parallel connection, and any combinations thereof.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A system for automated tape dispensing, wherein the system comprises:

a multi-axis robotic arm affixed to a first surface at a proximal end;

at least a mounting axle plate coupled to a distal end of the multi-axis robotic arm, wherein the at least a mounting axle plate comprises a mounting axle protruding from a second surface of the at least a mounting axle plate;

at least a mounting axle motor coupled to the mounting axle of the at least a mounting axle plate, wherein the at least a mounting axle motor is configured to conditionally rotate the mounting axle upon receipt of a system command;

at least an adhesive roll attached to the mounting axle of the at least a mounting axle plate, wherein the at least an adhesive roll comprises a strip of adhesive; and a plate coupled to a distal area of the second surface of the at least a mounting axle plate, wherein the plate comprises:

linear guide rails coupled to a third surface of the plate, wherein the linear guide rails are configured to guide a translation of the plate;

at least a piston coupled to the second surface of the at least a mounting axle plate, wherein the at least a piston is configured to power the translation of the plate on the linear guide rails;

at least a cutting system coupled to the third surface of the plate, the at least a cutting system comprising at least a blade, wherein the at least a cutting system is configured to cut, using the at least a blade, a segment of the strip of adhesive;

at least a tensioning system coupled to the third surface of the plate, the at least a tensioning system comprising a guide roller, wherein the at least a tensioning system is configured to apply a force to the guide roller and against the strip of adhesive; and at least a powered roller motor coupled to the third surface of the plate, the at least a powered roller motor configured to drive the strip of adhesive in a forward direction.

2. The system of claim 1, further comprising at least a computing device communicatively connected to the at least a mounting axle motor and the at least a powered roller motor wherein the computing device comprises:

a memory; and at least a processor communicatively connected to the memory, wherein the memory contains instructions configuring the at least a processor to:

receive, using the at least a processor, an input; and generate an output, wherein the output is executed at the at least a mounting axle motor and the at least a powered roller motor.

3. The system of claim 2, wherein the computing device is further configured to generate a usage report, wherein generating the usage report comprises aggregating, using the at least a processor, operational data as a function of one or more inputs received from at least a sensor communicatively connected to the at least a processor.

4. The system of claim 2, further comprising at least a sensor communicatively connected to the at least a computing device, the at least a sensor coupled to the strip of adhesive, wherein the computing device is further configured to receive sensor data from the at least a sensor configured to indicate a position of the strip of adhesive.

5. The system of claim 4, wherein the computing device is further configured to:

receive, using the at least a processor, the sensor data comprising a length of a strip of adhesive;

generate, using the at least a processor, an alert as a function of the sensor data, wherein generating the alert comprises comparing the length of the strip to one or more predetermined thresholds; and transmit, using the at least a processor, the alert to a graphical user interface of a downstream device.

6. The system of claim 2, wherein the computing device is further configured to:

dynamically adjust a speed of the at least a mounting axle motor and the at least a powered roller motor based on sensor data;

receive, using the at least a processor, feedback associated with at least a dispensing rate of the at least an adhesive roll;

analyze, using the at least a processor, the feedback to determine a deviation from one or more target parameters; and generate, using the at least a processor, one or more control signals to the at least a mounting axle motor and the at least a powered roller motor to modify an axle motor speed and a power roller motor speed as a function of the deviation.

7. The system of claim 2, wherein the output generated by the computing device comprises one or more of speed commands and blade activation signals wherein the speed commands are configured to control a rotational speed of at least a motor associated with the at least a mounting axle and wherein the blade activation signals are configured to trigger the at least a cutting system to sever the strip of adhesive at a designated length based on one or more operational criteria.

8. The system of claim 2, wherein the at least a piston exerts a variable force based on positional feedback from the computing device.

9. The system of claim 2, further comprising at least a display configured to generate, using the at least a processor, a system status condition as a function of one or more of sensor data and an operational threshold.

10. The system of claim 1, wherein the at least a piston and the at least a cutting system comprise a pneumatic system.

11. The system of claim 1, wherein the at least a tensioning system comprises at least a spring, wherein the at least a spring applies the force to the guide roller.

12. The system of claim 1, wherein the at least a mounting axle plate comprises a quick-release locking mechanism configured to secure and release the at least an adhesive roll.

13. The system of claim 1, further comprising a housing enclosing the at least an adhesive roll and the at least a mounting axle, the housing comprising a transparent window.

14. The system of claim 1, wherein the at least a mounting axle further comprises an adjustable axle fitting, wherein the adjustable axle fitting accommodates one or more sizes associated with the at least an adhesive roll.

15. The system of claim 1, wherein each of the at least a linear guide rails, the at least a piston, the at least a cutting system, the at least a tensioning system, and the at least a powered roller motor is adjustably mounted to the plate using a plurality of holes formed in the third surface of the plate.

16. The system of claim 15, wherein the plurality of holes on the third surface of the plate comprises one or more of a grid pattern and a slot pattern that enables modular reconfiguration.

* * * * *